US005588282A

United States Patent [19]

Hartness

[11] Patent Number: 5,588,282

[45] Date of Patent: Dec. 31, 1996

[54] CONTINUOUS MOTION CASE PACKING APPARATUS AND METHOD

[75] Inventor: Thomas P. Hartness, Greenville, S.C.

[73] Assignee: Hartness International, Inc., Greenville, S.C.

[21] Appl. No.: 338,026

[22] Filed: Nov. 10, 1994

[51] Int. Cl.[6] ..... B65B 5/08; B65B 21/06; B65B 21/18

[52] U.S. Cl. ..... 53/473; 53/248; 53/251; 53/497; 53/539

[58] Field of Search ..... 53/247, 248, 251, 53/250, 539, 473, 475, 497, 496, 495, 249

[56] References Cited

U.S. PATENT DOCUMENTS 3,553,927 1/1971 Anglade, Jr. ..... 53/539 X
3,805,476 4/1974 Kawamura et al. ..... 53/539 X
4,055,943 11/1977 Reichert ..... 53/539 X
5,257,888 11/1993 Kronseder ..... 53/247 X

*Primary Examiner*—James F. Coan
*Attorney, Agent, or Firm*—Cort Flint

[57] ABSTRACT

A continuous motion apparatus and method are disclosed where discrete, successive slugs of articles are picked up by pick-up heads revolving in a vertical plane path, and are transferred over a linear transfer section of that path to a case packing station. A vertical motion mechanism lowers the pick-up heads at the case packing station to gently place the slugs into indexed cases in a reliable manner.

76 Claims, 32 Drawing Sheets

Fig. 23
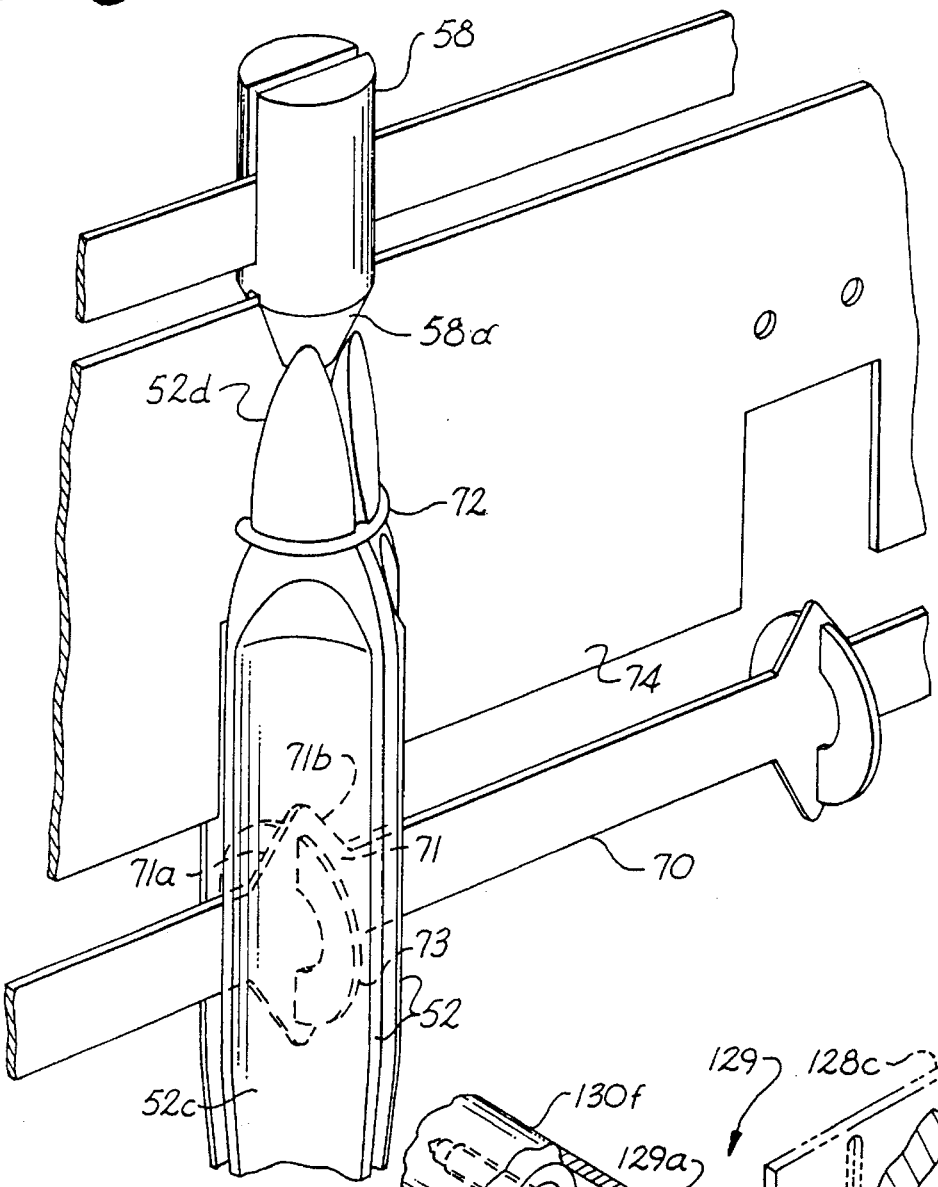
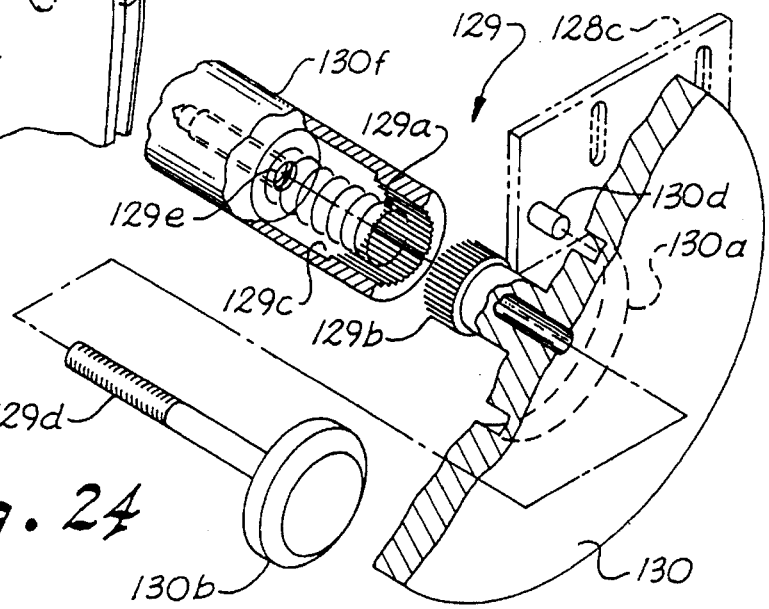
Fig. 24

CONTINUOUS MOTION CASE PACKING APPARATUS AND METHOD

BACKGROUND OF THE INVENTION

The invention relates to an apparatus and method for packing articles into cases, and particularly, to the packing of articles into cases using an apparatus and method having a continuous motion in which successive slugs or groups of moving articles are continuously picked up and transferred into moving cases.

In the art of case packing, large numbers of articles must be grouped and packaged rapidly by an apparatus that will function dependably without damage to the articles processed. Case packing apparatus has been generally categorized as either intermittent case packing or continuous case packing. Most recently, attention has been directed to continuous case packing in order to increase production. However, the continuous case packing has brought increased problems with handling the processed articles without damage.

In the continuous case packing apparatus, articles conveyed in at least one row of articles are divided up into slugs or groups of articles which are fed to a pick-up position. The slugs of articles are picked up at the pick-up position by article grippers carried by an orbital handling conveyor. The slugs are transferred to a case loading position where the grippers release the slug of articles into a case. The articles can be released either simultaneously or sequentially as the case is conveyed beneath the slug of articles. Apparatus of this type may be either of the "drop packer" type or "placement packer type". In the drop packer type, the articles are allowed to drop at least a small distance into the case after release. In the placement packer type, the drop, if any, is minimal and the articles are essentially placed gently onto the bottom of the case.

Various case packers, generally of the continuous motion type, using a vertical orbital conveyor are shown in U.S. Pat. Nos. 5,212,930; 4,541,524; and 4,294,057. The first patent shows depositing the articles sequentially and individually, rather than as slugs, into partitioned cases without positively gripping the articles. The latter two patents use gripper devices to grip the articles.

U.S. Pat. No. 4,457,121 discloses a continuous motion bottle packer wherein a plurality of grids are mounted individually on spokes of a vertical wheel so that each grid moves through an article infeed position where groups of articles are fed into the grid without interrupting the forward speed. The wheel moves the grids and articles to a lower discharge position where the groups of articles are dropped into a case without interrupting the motion of the articles in the direction of a case conveyor which indexes the cases. While continuous, this bottle packer generally of the drop packer type wherein the bottles are dropped into the case through resilient fingers. Also, a control problem is created due to the necessity of varying the speed between the rotating grids and the linearly moving cases in order to coordinate reliable timing of the grid and the case at the case packing position for reliable insertion of the slug. Angular and horizontal accelerations of the articles and their contents are also encountered due to the rotary wheel motion during the transfer which may be detrimental to the article and/or contents.

Continuous motion case packers are also known having a vertical rotating wheel which carries a plurality of arms which include two articulating links. A set of article grippers is carried on the ends of the articulating arms. The relative angular positions of the articulating links are controlled to place the article grippers over a slug of articles at a pick-up position, positively grip the slug, and lower the slug to a case packing position where moving cases are indexed with the moving gripper sets. However, during the angular descent from the pick-up position to the case packing position, both horizontal and vertical accelerations are encountered by the articles which are gripped only at their tops or necks. U.S. Pat. No. 5,313,764 discloses a continuous motion case packer wherein the articles and cases are indexed and conveyed on parallel conveyors arranged one above the other. Steering bars which correspond to the bars of a parallelogram move a gripper set, in the same general direction as the article and case conveyance, between the pick-up and case packing positions. However, again, horizontal and vertical accelerations are produced on the pick-up head and the articles, and timing becomes a problem.

Continuous case packers are also known in which a horizontal rotary carousel is used to move vertically reciprocating gripper sets in a horizontal plane. The reciprocating gripper sets pick up a slug of articles at one position and transfer the slug of articles to a second position where the gripper set is lowered to deposit the articles into a case. However, the disposition of the rotary carousel in a horizontal plane requires an inconvenient floor lay-out which also occupies a large amount of floor space. Typically, parallel conveyor arrangements are needed for the articles and the cases adding to the floor space problem. The path of the gripper sets between the slug pick-up position and the case packing position is also typically curved producing angular accelerations and forces on the articles, and the curved article path intersects the path of the conveyed case only for a brief interval. In various of the rotary carousel types, it is known to deposit the articles by lowering the articles, already gripped by the gripper set, through resilient fingers that guide the articles into partitioned cases.

Case packers, generally of the intermittent type, are shown in U.S. Pat. Nos. 3,553,932 and 3,505,787 which also disclose using combinations of a lifting head having suction cups and bottle grids having pockets for picking up containers and depositing them into cases. The containers and the cases are conveyed on parallel conveyors rather than in-line conveyors, and the transfer from the pick-up position to the case loading position is lateral, or transverse, to the flow of containers and cases. U. S. Pat. No. 2,277,688 discloses another case packer using an arrangement of a gripper set and a bottle guide set to package the containers into a case. These type of case packers are generally non-continuous as compared to the continuous motion in-line transfer case packers described above where neither the flow of articles nor the flow of the cases is stopped during operation of the packer.

Accordingly, an object of the invention is to provide an improved continuous motion case packing apparatus and method.

Another object of the invention is to provide a continuous motion case packing apparatus and method in which slugs of articles are picked up, transferred, and deposited in a case in a reliable, continuous manner without damage to the articles or their contents.

Another object of the invention is to provide a continuous motion case packing apparatus and method having a slug feeder which can be adjusted to change over the size of the slug in a quick and easy manner without the need of extensive machine down time and substitution and reassembling of mechanical parts.

Another object of the invention is to provide a continuous motion case packing apparatus and method in which slugs of articles are picked up and transferred to a case packing station over a horizontal linear transfer path in which the horizontal speed of the slug is constant, and depositing into a case is done in a gentle vertical motion.

Still another object of the invention is to provide a continuous motion case packing apparatus and method having a grid head which includes a matrix of grid finger chutes in which slugs of articles are picked up from overhead, and retained with positive locking within the chutes for transfer and deposit into a case in a reliable and continuous manner.

Yet another object of the invention is to provide a continuous motion case packing apparatus and method in which a revolving carriage moves a plurality of transfer arms having sliding article pick-up heads in a vertical plane, closed curve path in a manner that the slugs of articles conveyed in the same plane are picked up, transferred, and deposited into indexed cases conveyed in the same plane in a reliable, continuous manner, and with a minimum amount of floor space.

SUMMARY OF THE INVENTION

The above objectives are accomplished according to the present invention by providing a continuous motion apparatus and method for packing slugs of articles continuously fed at fixed intervals into indexed cases indexed and conveyed at the intervals. The slugs are continuously picked up by a unique carriage with reciprocating article pick-up heads spaced at the fixed intervals, and moved at a constant horizontal speed across a linear transfer section. The articles may be packed into partitioned or non-partitioned cases. The apparatus comprises a slug feeder which receives at least one row of articles and forms successive slugs containing a predetermined number of the articles which are continuously fed to a slug pick-up station where the slugs are continuously picked up for transfer to a case packing station. The revolving carriage carries a plurality of article transfer arms. A plurality of the article pick-up heads is carried by the transfer arms which reciprocate in a linear motion relative to the transfer arms for picking up the slugs at the slug pick-up station, and lowering the slugs at the case packing station for deposit into the indexed cases. The carriage carries the transfer arms and pick-up heads in a curved, vertical plane path which includes the linear transfer section between the slug pick-up station and the case packing station. An actuator is associated with the pick-up heads and has a first position in which a slug of articles is retained by the pick-up head at the slug pick-up station for transfer. The actuator has a second position in which the slug of articles is released for deposit into the case at the case packing station. A case indexing conveyor conveys the indexed cases to the case packing station for receiving the released slug in synchronization with the moving carriage and the slug feeder.

Preferably, the pick-up heads include grid heads having a plurality of pivoting grid fingers which are arranged in corners or sides of a grid array corresponding to an array of the articles in the slug, and the cells in a partitioned case. The grid fingers define grid chutes having upper ends and lower ends, and the grid chutes receive the slug of articles. The grid chutes have an open position wherein the lower chute ends are open so that the articles are received into the chutes through the lower ends. The apparatus further includes a vertical motion mechanism for lowering the grid heads relative to the transfer arms over the slug of articles with the grid chutes in the open position. The grid fingers have a closed position for retaining articles in the chutes. The actuator acts upon the grid fingers to move the grid fingers to the open and the closed positions. The actuator includes a grid actuator mechanism for positively holding the grid fingers in the closed position to positively retain the articles in the grid head. The pick-up heads may also include gripper heads carried by the transfer arms for sliding movement on the transfer arms in linear alignment with the grid heads. The gripper heads have a plurality of article grippers arranged in a matrix corresponding to the grid chute and slug array, and the grippers are constructed and arranged to attach to an upper portion of the articles to lower the slug gently into the case. A gripper actuator actuates the grippers, and an actuator arm is carried on the gripper head which engages an abutment carried on the grid head at the case packing station for releasing the slug. The grippers include pivoting gripper jaws constructed and arranged to engage the articles to center the articles in the chutes of the grid head.

The case indexing conveyor extends in longitudinal alignment with the slug feeder, and indexes the cases at prescribed intervals at which the slugs are fed by the slug feeder and the transfer arms are moved by the carriage. A synchronized drive for the case indexing conveyor, slug feed conveyor, and the carriage, feeds and conveys the slugs and the cases in unison at a constant horizontal speed for packing. The carriage moves the transfer arms in a closed cyclic path which includes a linear transfer section at least between the pick-up station and the case packing station and a curvilinear return path from the case packing station to the pick-up station. The carriage moves the transfer arms and pick-up heads at a generally constant horizontal speed across the linear transfer section to transfer the slug of articles from the slug pick-up station to the case packing station generally without horizontal acceleration of the articles. The carriage moves the transfer arms and pick-up heads at a generally constant horizontal speed along the linear transfer section to transfer the slug of articles from the slug pick-up station to the case packing station generally without horizontal acceleration of the articles. A vertical motion mechanism connects to the pick-up heads and guides the pick-up heads in a vertical motion so that the pick-up heads are lowered to the case packing station while the carriage moves the pick-up heads at the constant horizontal speed.

In an advantageous form of the invention, the slug feeder includes a slug feed conveyor, a slug metering section, and spaced side rails defining at least one lane for receiving the row of articles which extends through the slug conveyor and slug metering sections. The slug metering section includes a revolving flight bar mechanism which has a plurality of engaging flight bars which engage a last of the articles in a slug for conveying the slug of articles through the metering section to the slug pick-up station. The flight bars extend across the slug metering section and rise above a back article in a row of a first slug and a front article in a row of a second slug to tilt the front article rearward and separate the first and second slugs of articles. The slug feed conveyor has a first speed for feeding the articles at a first rate and a second speed for feeding the articles at a second rate which is slower than the first rate. The slug feed conveyor operates at the second speed at least momentarily as the flight bar engages the back articles which facilitates dividing of the articles in the row. A metering block is disposed in each lane. A metering distance is generally defined between the metering block and the flight bar which determines the number of articles in a row of the slug of articles. The metering block is carried by an adjustable carrier by which the metering distance between the metering block and the flight bar may be adjusted so that the number of articles in the row may be adjusted. A drive mechanism moves the metering block in cyclic motions in and out of a conveyance path of the articles in the slug metering section in synchronization with the revolving flight bar. The drive mechanism includes a cam plate carried on the carrier for guiding the metering block in the cyclic motions which include reciprocating horizontal and vertical motions, and a timing cam connected to the cam plate for timing and driving the metering block in the cyclic motions. The timing cam is driven by a drive shaft and the apparatus includes an adjustable coupling which secures the timing cam to the drive shaft by which the relative rotational position between the timing cam and drive shaft may be varied corresponding to the metering distance between the metering block and the flight bar. The slug metering section includes bottom skids carried centrally in the bottom of each lane between adjacent side rails for supporting the bottom of the articles in the lane. The metering block is associated with each skid and slides relative thereto. A plurality of spaced cantilevered pick-up blades are arranged in parallel alignment near an end of the metering section which constitute the slug pick-up station.

Advantageously, the grid head includes a locking element associated with the grid fingers for positively maintaining the grid fingers in a chute open position wherein the fingers are vertically positioned near corners of the chutes defined by finger sides. A plurality of spacer bars are spaced across the grid head. The grid fingers are pivotally carried by the spacer bars at a pivot intermediate an upper finger portion of the fingers and a lower main body portion of the fingers. A locking grid is disposed above the upper portions of the fingers and carry the locking elements so that the locking elements engage the upper finger portions and maintain the fingers locked in the open chute position. The locking grid comprises a frame and a plurality of support bars which extend across the frame upon which the locking elements are carried. The locking elements have an apex portion which engages terminal ends of the upper finger portions of the grid fingers for urging the fingers into the chute open position. At least one biasing member urges the locking grid towards the grid head and urges the apex portion of the locking elements into contact with the upper portions of the fingers.

Preferably, the grid actuator is provided in the form of an actuator linkage assembly for moving the fingers toward the center of the grid chutes, and an actuator arm which connects to the actuator linkage assembly. A first abutment is carried near the transfer arms in the linear transfer section. The actuator arm is constructed and arranged for engaging the first abutment to move the grid fingers and close the chutes after the grid fingers are received over the slug of articles at the pickup station. The actuator arm includes a fork which has first and second arms. The first arm is engaged by the first abutment to close the grid chutes. The second arm is engaged by a second abutment disposed along the linear transfer section to allow the fingers to move and open the grid chutes after the grid fingers have penetrated a desired distance into the case at the case packing station. The vertical motion mechanism includes guide bearings which are slidably carried by the transfer arms and a cam track which is carried by the frame. A cam roller is carried by the guide bearings which follows the cam track, and the grid heads are carried by the guide bearings for following the cam track. The reciprocating article gripper heads are carried by the transfer arms in alignment with the grid heads by bearing blocks. The gripper heads hold the articles in the slug in a positive manner in conjunction with the grid heads.

In accordance with the invention, a method is also disclosed wherein articles are continuously packaged into cases. The method comprises continuously conveying the articles in at least one longitudinal row and continuously dividing the articles into separate, successive slugs of articles wherein the slugs contain a prescribed number of articles. The method further includes conveying the slugs of articles to a slug pick-up station. The slug of articles are picked up at the pick-up station by a linearly reciprocating pick-up head which is carried on a transfer arm. The transfer arm rotates in a vertical plane curved path which includes a linear transfer section between the pick-up station and a case packing station to continuously transfer the slugs. The pick-up head moves vertically in a linear motion to deposit the slug of articles into the case at the case packing station. In another aspect of the method, slugs of articles are continuously picked-up at the pick-up station by grid heads having a plurality of grid chutes arranged in a matrix corresponding to an array of the articles in the slug. The grids are continuously moved into a slug pick-up position directly above the slugs at the slug pick-up station. The grid heads are moved downwardly over the slugs of articles with a lower end of the chutes being open for receiving the articles with the chutes. The articles are retained in the chutes of the grid head while the grid heads are moved from the slug pick-up station to the case pick-up station. The slugs of articles are released from the grid chutes into the indexed cases at the case packing station. The method also contemplates providing a gripper head having a plurality of grippers for gripping the articles, and reciprocating the gripper head in linear alignment with movements of the grid heads. The articles are gripped with the gripper head as the grid chutes move downwardly over the slug for retaining the articles together with the grid head for transfer to the case packing station. In accordance with still further aspects of the invention, the articles are conveyed on a slug feed conveyor to a slug metering section. A first article is fed in the row against a metering device while engaging a last article in the row with a revolving abutment whereby the slug of articles is defined by a metering distance between the metering device and the abutment to fix the number of articles in the slugs. The metering device reciprocates out of contact with the first article so that the abutment may convey the slug away from the metering section to the slug pick-up station. One of the metering device or revolving abutment is mounted on an adjustable carrier so that the metering distance may be adjusted to vary the slug size. Preferably, metering device is mounted on a drive mechanism which moves the metering device in translational and reciprocating motions. The drive mechanism for the metering device is mounted on a moveable carrier so that the metering distance between the metering device and the bar may be adjusted to vary the number of articles in the slug.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is a schematic diagram showing the connection between FIG. 2A and FIG. 2B;

FIG. 2H is a schematic elevation illustrating a continuous motion case packing apparatus and method according to the invention illustrating the relative positions of an article transfer arm having gripper and grid heads, a slug of articles, and indexed case after depositing the slug of articles in a case;

FIG. 2I is a schematic view of a vertical plane, curved path of the article transfer arm of FIGS. 2C–2H traveled during a complete cycle of the arm according to the invention;

FIG. 3 is a schematic diagram showing the connection between FIG. 3A and FIG. 3B;

FIG. 10 is an enlarged, partial view of a grid head having a plurality of corner grid fingers defining grid chutes according to the invention for picking up articles and transferring articles in a continuous motion apparatus and method according to the invention for being deposited in a partitioned case and the like;

FIG. 23 is a perspective view of corner grid fingers and orthogonal chute forming members which form four common corners of adjacent grid chutes according to the invention.

DESCRIPTION OF A PREFERRED EMBODIMENT

Figure 1:
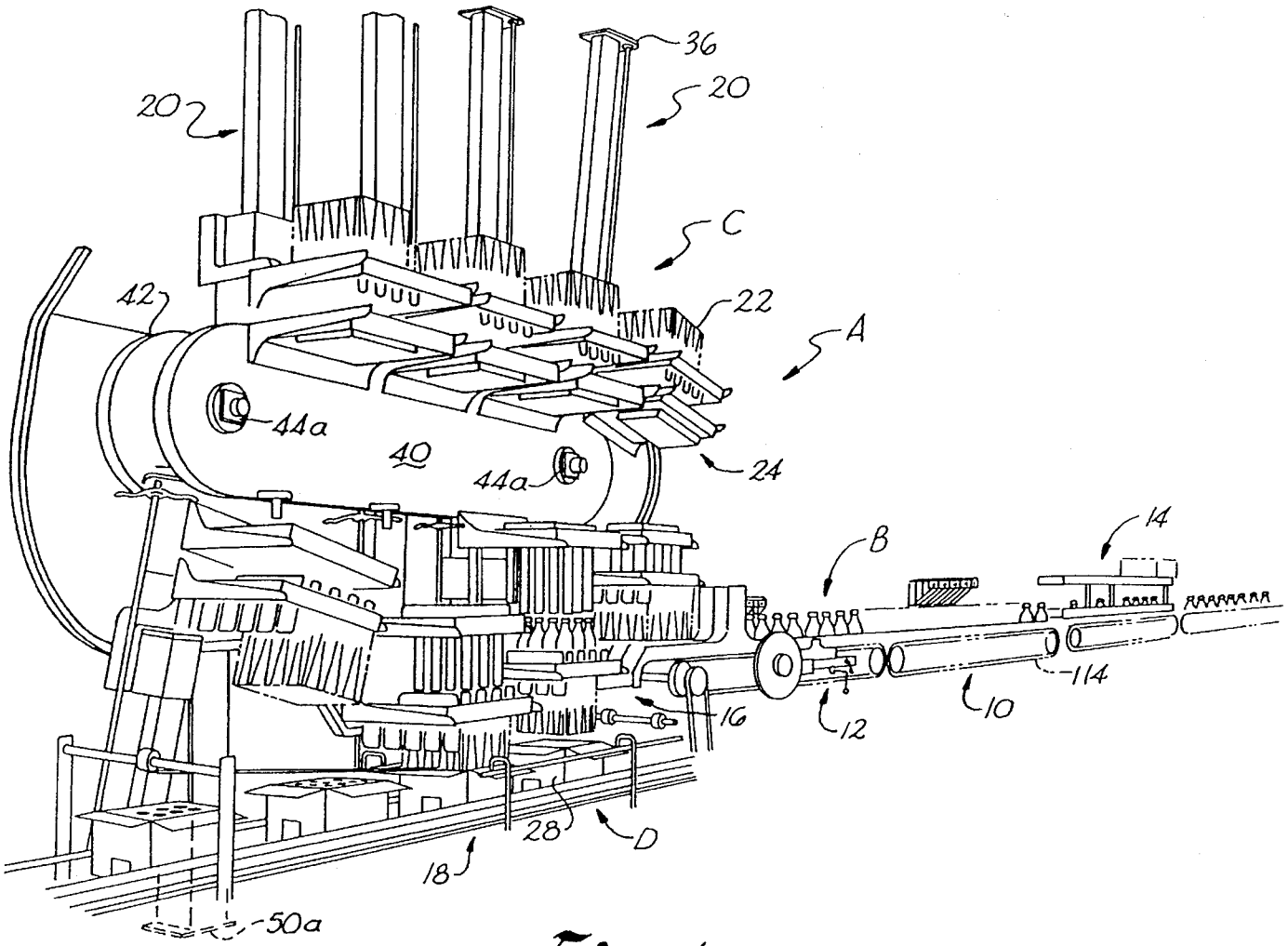
FIG. 1 is a perspective view illustrating a continuous motion case packing apparatus and method according to the invention.

Referring now in more detail to the drawings, as can best be seen in FIG. 1, an apparatus and method for packing articles into cases in a continuous motion is illustrated, designated generally as A. The apparatus includes a slug feeder, designated generally as B which includes a slug feed conveyor 10 and a slug metering section 12. Slug feeder B receives a continuous flow of articles which are conveyed in at least one longitudinal row from a laner section, designated generally as 14. Slug feeder B continuously forms slugs containing a predetermined number of articles, as metered by slug metering sections 12, and continuously feeds the slugs to a slug pick-up station, designated generally as 16. The slugs of articles are picked up at the pick-up station and transferred to a case packing station, designated generally as 18. A revolving carriage, designated generally as C, carries a plurality of article transfer arms 20. A plurality of article pick-up heads in the form of stacked grid heads and gripper heads, designated generally as 22, 24, respectively, are slidably carried on the transfer arms and reciprocate in a linear motion for picking up the slug of articles at pick-up station 16.

Figure 2A:
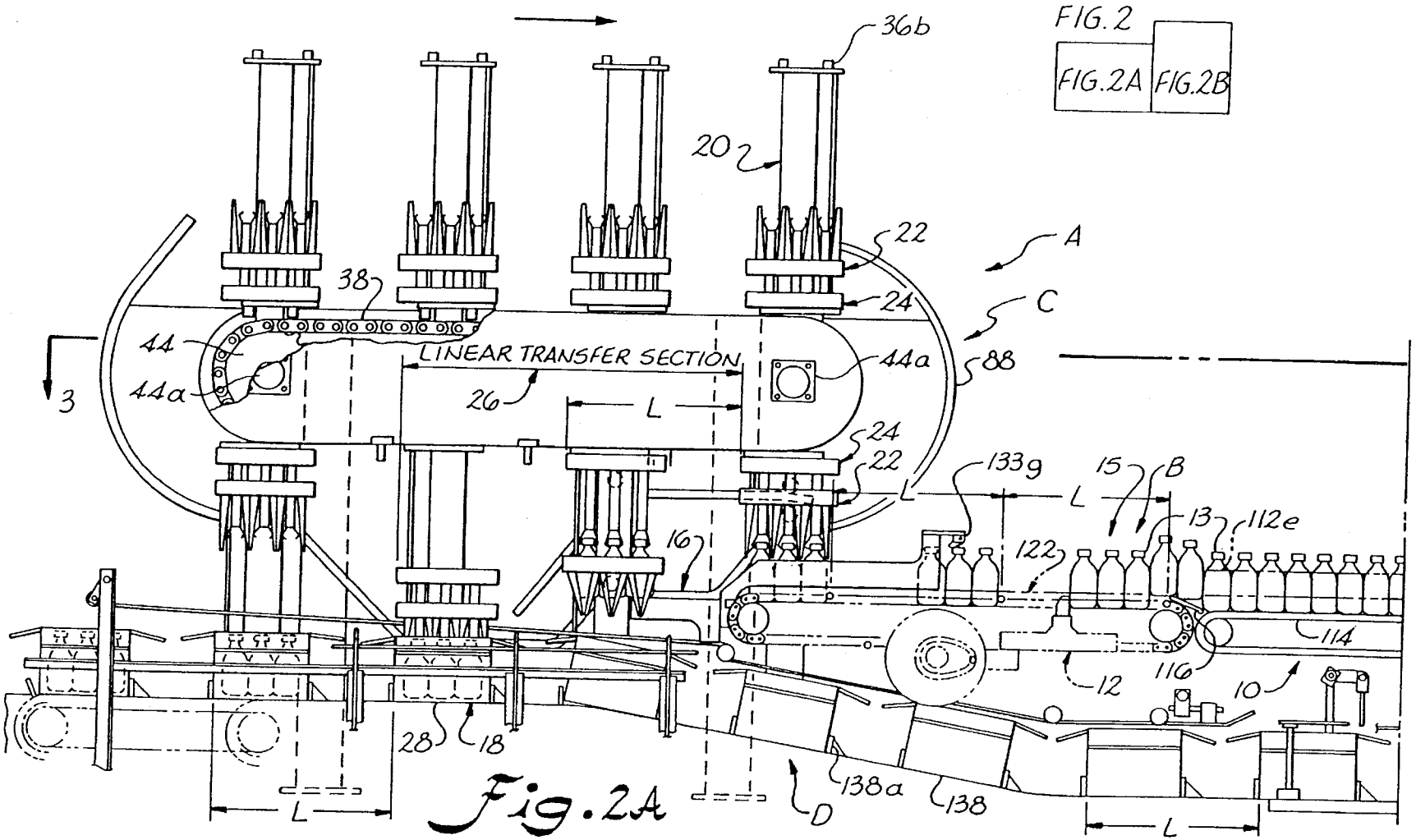
FIG. 2A is a front elevation of a continuous motion case packing apparatus and method according to the invention.

As can best be seen in FIG. 2A, revolving carriage C carries transfer arms 20 and the article pick-up heads in a curved path which includes a linear transfer section 26 which includes the illustrated horizontal distance between pick-up station 16 and case packing station 18 over which the pick-up heads are lowered vertically to gently deposit the articles into a case. For this purpose, a case indexing conveyor, designated generally as D, is disposed below the slug feeder and revolving transfer arms to provide a continuous flow of indexed cases 28 to the case packing station 18 where the articles are gently deposited into the case. For this purpose, as can best be seen in FIG. 2A, an interval "L" is provided which spaces the continuous, successive slugs 15, transfer arms 20 and indexed cases 28 so that the case packing process occurs in a synchronized and continuous manner. It is also pointed out, and will be explained fully later, that the rate of delivery, or horizontal speed, of the slugs, transfer arms, and indexed cases is the same. The center-line in the direction of conveyance for article pick-up heads 22, 24, slugs 15, and indexed cases 28 lie in a common vertical plane within linear transfer section 26. The horizontal speed of transfer arms 20 and article pick-up heads over the linear transfer section is constant. This enables the pick-up heads and cases to track one another accurately for article transfer and case packing. This also provides reliable insertion of the pick-up heads and release of the articles into the case since only a vertical motion is necessary due to the pick-up heads and cases being parallel and vertically aligned for a linear distance within the linear transfer section.

Figure 3B:
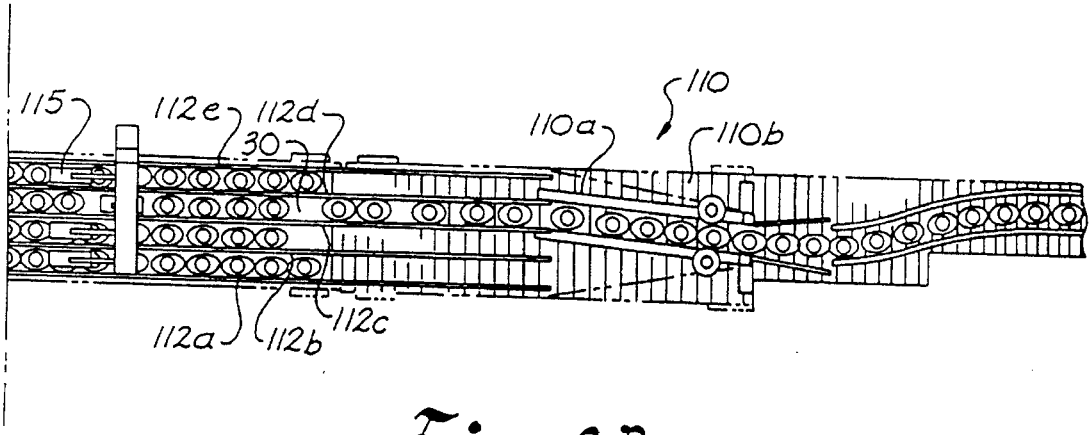
FIG. 3B is a top plan view taken along line 3 of FIG. 2B.
Figure 3A:
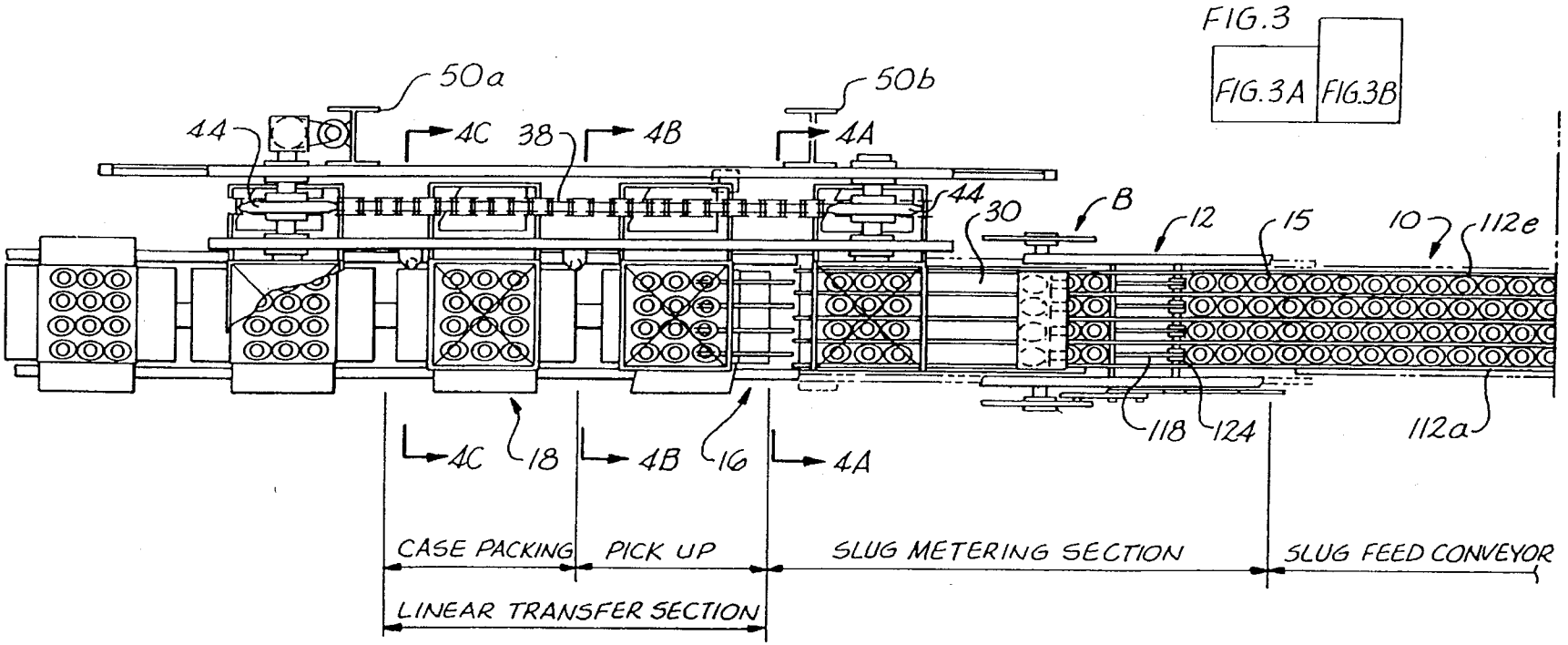
FIG. 3A is a top plan view illustrating a continuous motion case packing apparatus and method according to the invention wherein a slug feeder, slug pick-up station, case packing station, and linear transfer section are illustrated.

The size of slug 15 is determined by the number of longitudinal rows 30 (FIG. 3B) and the number of articles in the longitudinal row. In the example illustrated in the drawings, a slug the size of twelve articles is illustrated. This includes four longitudinal rows 30 containing three articles in a row. As determined by the slug metering section 12 (FIG. 3A). The size of the interval "L" in the illustrated embodiment may be 30 inches, for example. This provides sufficient space between successive slugs and indexed cases such that most standard slug and case sizes used in case packers may be accommodated. In particular, large cases with flaps folded to a horizontal position can be accommodated.

Revolving Carriage and Article Transfer Arms

Figure 4A:
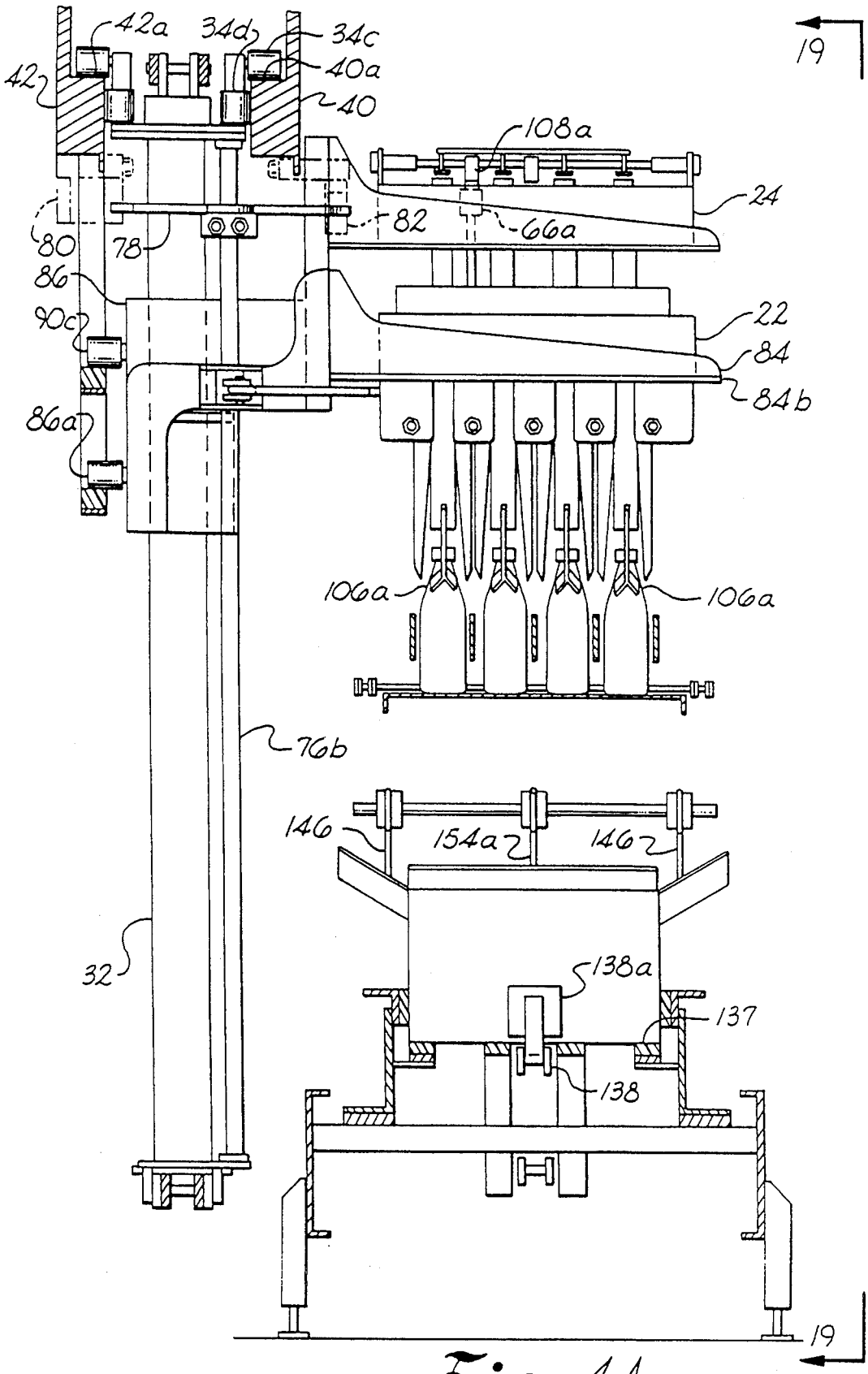
FIG. 4A is a sectional view taken along line 4A—4A of FIG. 3A of the position of a metered slug of articles prior to reaching a slug pick-up station.
Figure 5:
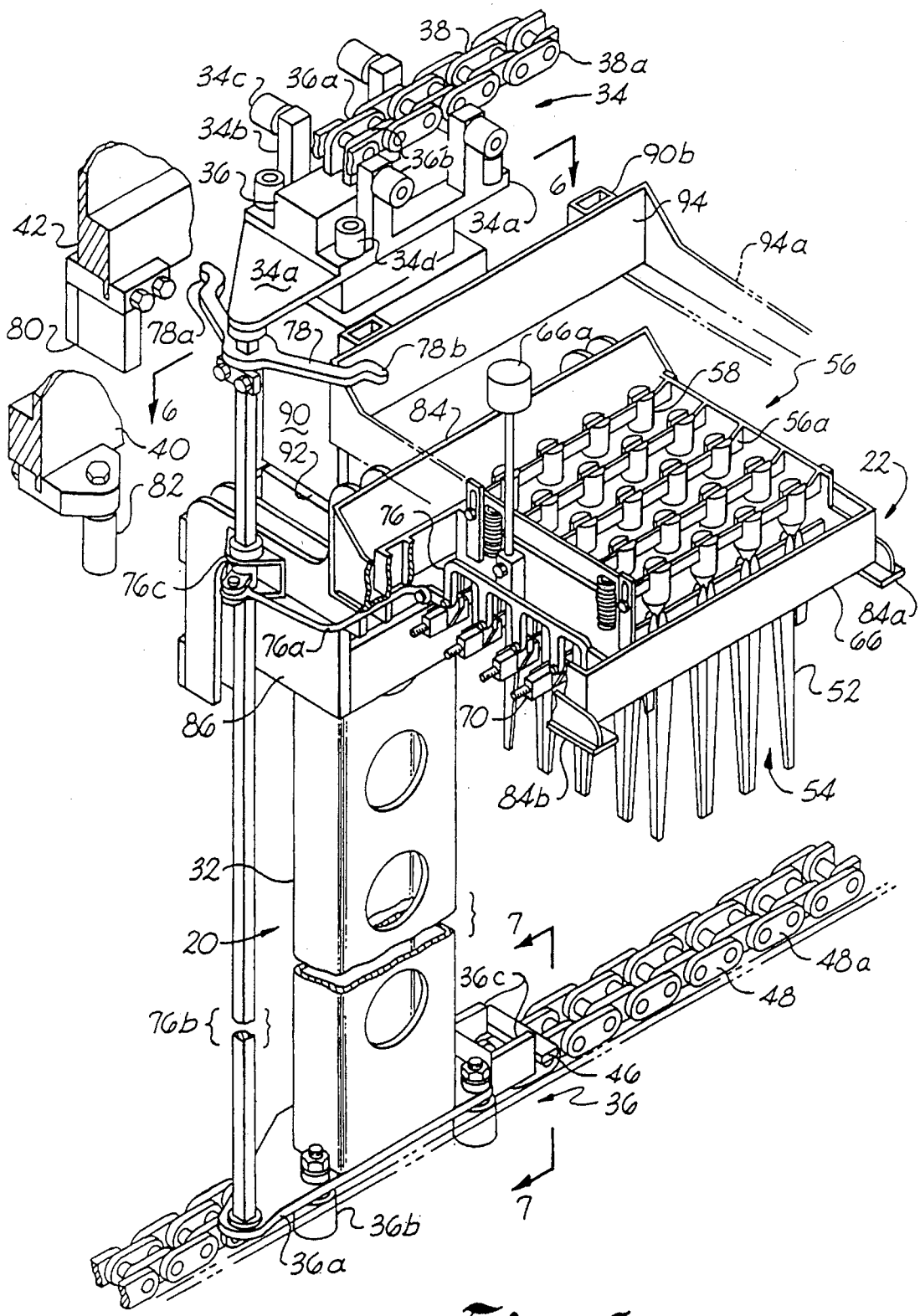
FIG. 5 is a perspective view of an article transfer arm and a reciprocating grid head having a matrix of grid chutes which fit over a slug of articles to capture and retaining the articles for transfer and case packing in a continuous motion apparatus and method according to the invention.

Referring now in more detail to the revolving carriage and transfer arms, as can best be seen in FIG. 5, each transfer arm 20 includes a steel beam 32 having chain connectors connected to the top and bottom of the beam designated generally as 34, 36. Top chain connector 34 includes a plate **34*a* affixed to beam 32 by any suitable means such as welding, and four legs 34*b* extending up from plate 34. Each leg 34*b* includes a roller 34*c*. Also affixed to plate 34*a* is a block 36 having a pair of link plates 36*a*, 36*b* attached to a carriage chain 38 as the two inside links. As can best be seen in FIG. 4A, carriage C includes a front carriage plate 40 and a rear carriage plate 42, spaced apart from each other. Rollers 34*c* of transfer arm connector 34 ride on tracks 40*a* and 42*a* of the respective carriage plates. At the same time, carriage chain 38 moves the transfer arms along a curved path which will be described in conjunction with FIG. 2I. In addition, side rollers 34*d* carried by plate 34*a* roll against the interior sides of carriage plates 40, 42. There are eight transfer arms 20 and each arm includes an upper connector 34 attached to carriage chain 38**.

Figure 15:
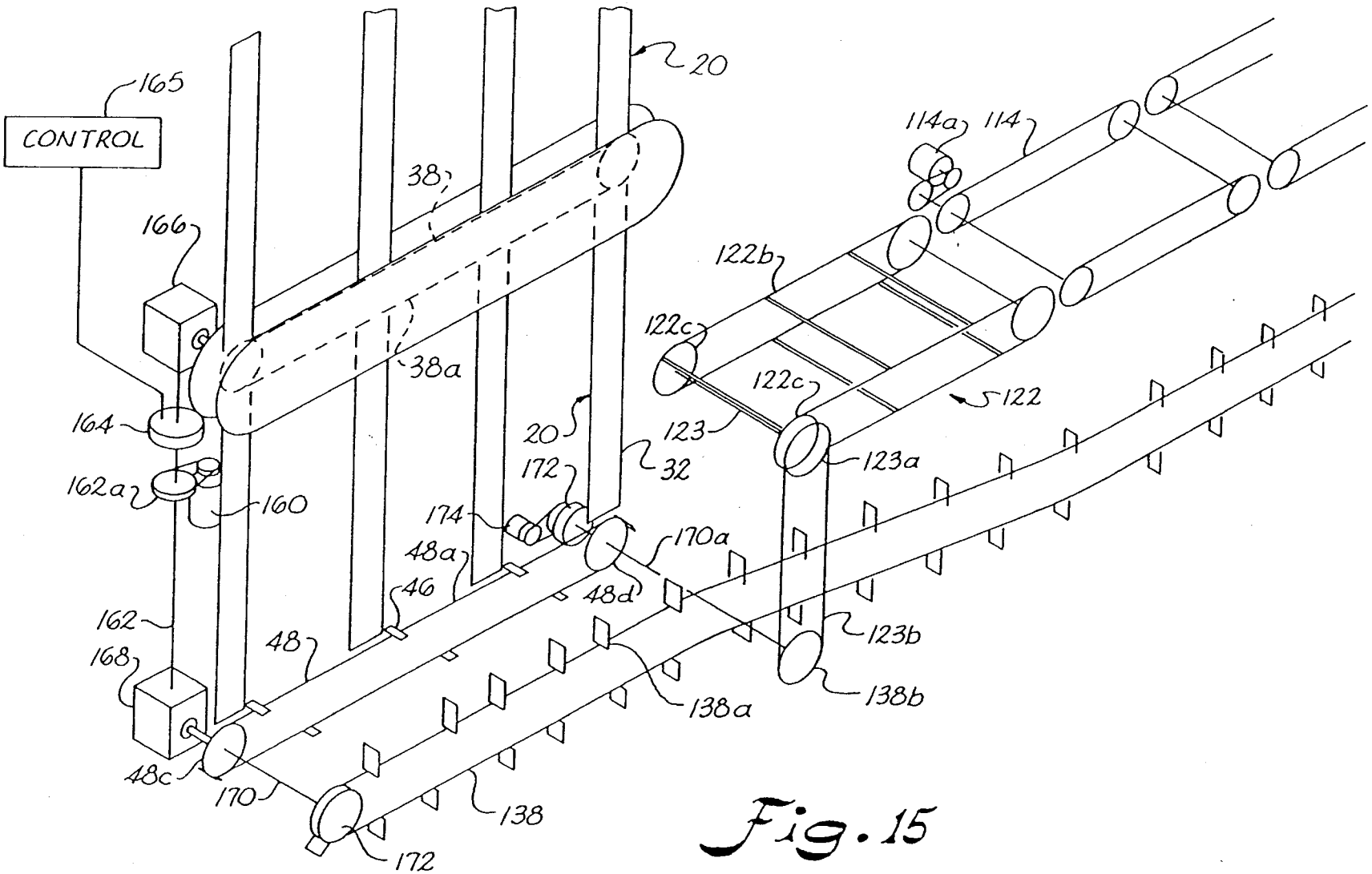
FIG. 15 is a perspective view illustrating a synchronized drive arrangement for a continuous motion case packing apparatus and method according to the invention for synchronizing the drives of a revolving carriage and article transfer arms/pick-up heads, a slug feeder, and a case indexing conveyor so that article pick-up heads, indexed slugs of articles, and indexed cases are delivered in a synchronized manner at the same delivery rate for case packing.

As can best be seen in FIGS. 2A and 3A, carriage chain 38 travels on two sprockets 44 which rotate on journals **44*a* carried on opposite ends of the front and rear carriage plates 40, 42. The drive for sprockets 44 will be explained in conjunction with FIG. 15. Lower transfer arm connector 36 includes a plate 36***a* having a pair of bottom rollers 36*b* (FIG. 5). A pair of horizontal connector plates 36*c* are affixed to plate 36 and are engaged by a bar 46 affixed to a lower transfer arm drive chain 48. Upper and lower chains 38, 48 are driven in the same direction and hold the opposing connector ends of transfer arms 20 in a fixed, vertical position as the chains run parallel and horizontal across the transfer section of the carriage (FIG. 15). In this position, transfer arms 20 will be connected between a lower run 38*a* of carriage chain 38 and an upper run 48*a* of bottom drive chain 48. Both ends of the transfer arm are thus positively conveyed during the pick-up, transfer, and depositing operations. This provides stability and reliability to these operations as the article pick-up heads reciprocate on the transfer arms. Carriage plates 40, 42 may be supported on any suitable frame which includes a pair of vertical standards 50*a*, 50*b* affixed to the carriage plates and bolted to a base or floor surface.

Figure 4B:
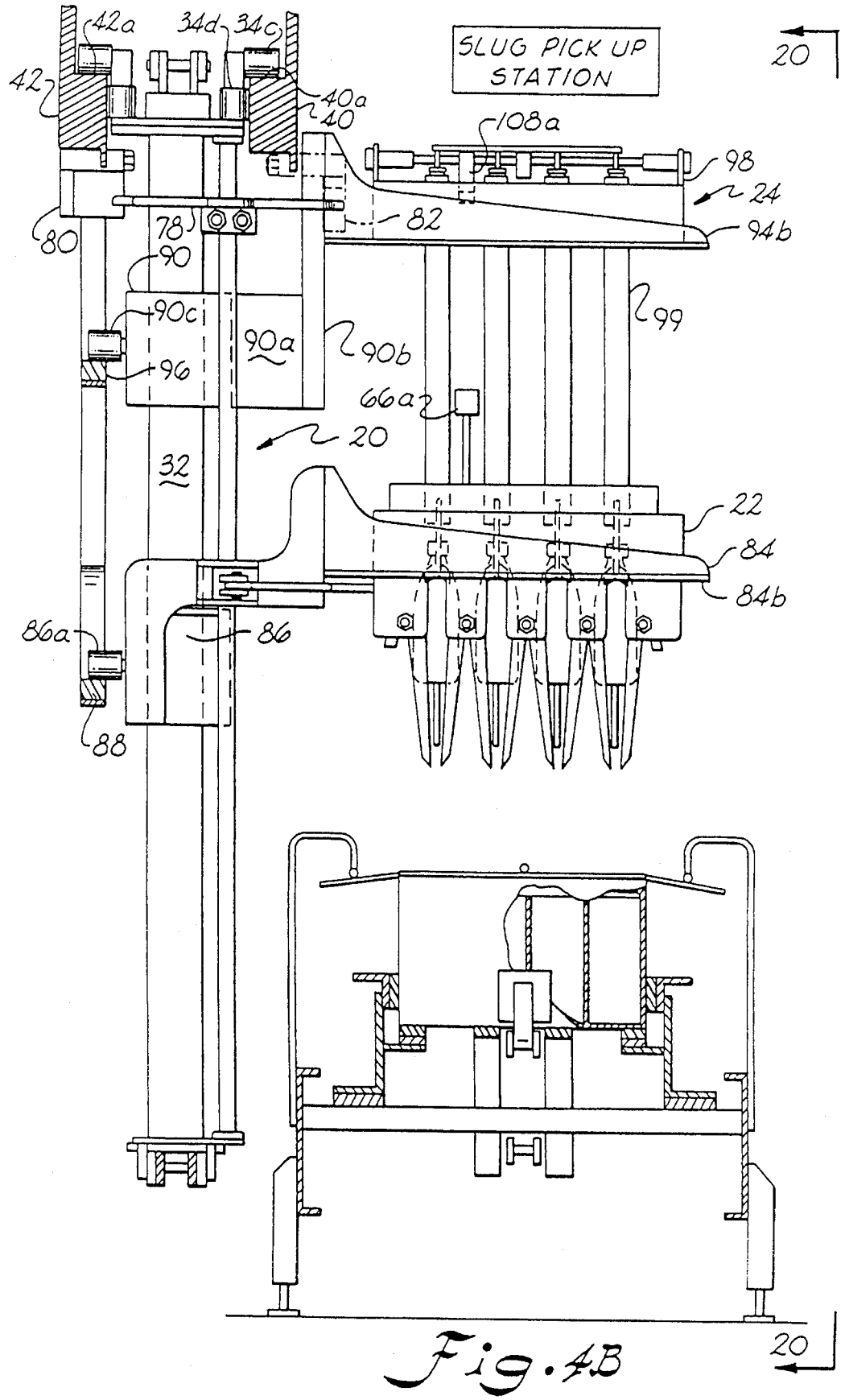
FIG. 4B is a sectional view taken along line 4B—4B of FIG. 3A of a slug pick-up station according to the invention.

Referring now to article pick-up heads 22, 24, it can be seen in FIG. 4B that pick-up head 22 includes a grid head and pick-up head 24 includes a gripper head. While in the preferred embodiment, both heads 22, 24 are slidably carried on the transfer arms, it is to be understood that the heads may also be used alone in certain applications.

Figure 10:
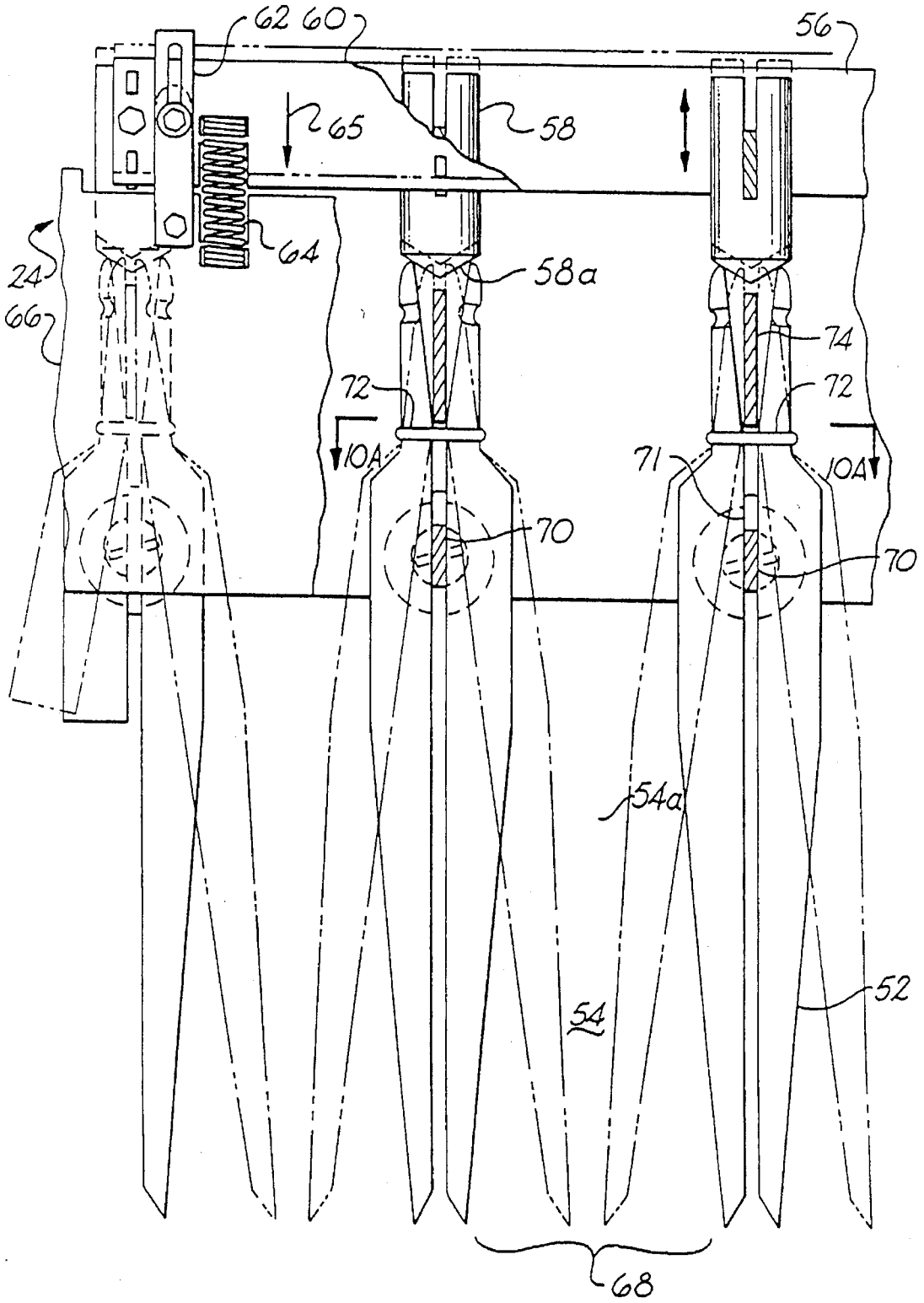
Figure 22:
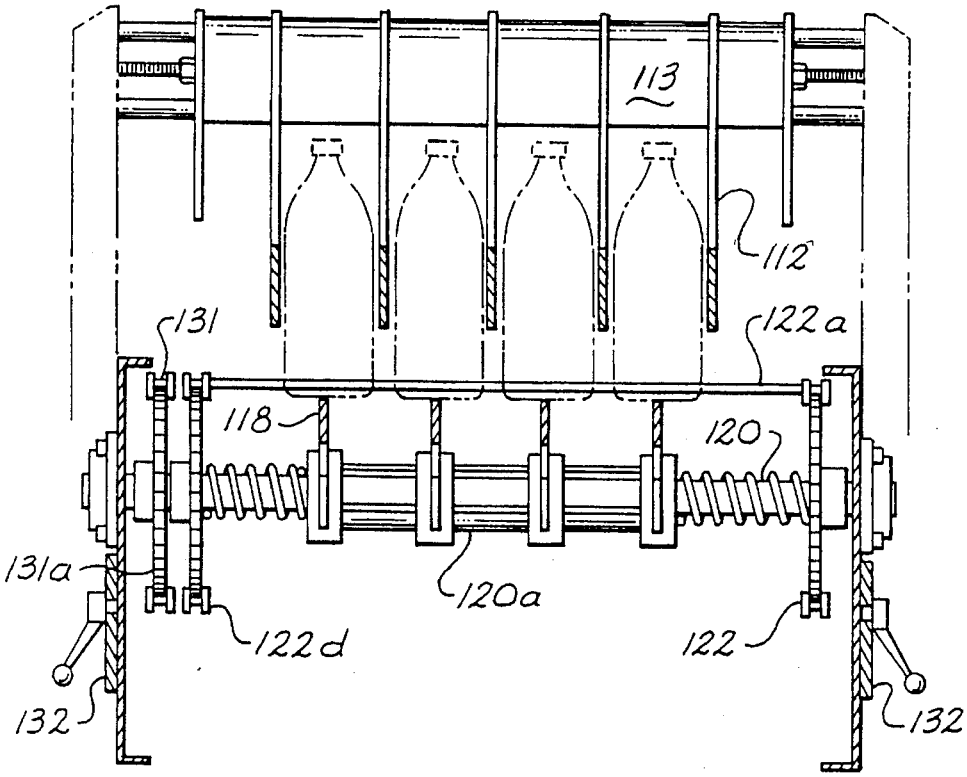
FIG. 22 is a sectional view illustrating an adjustable slug metering section according to the invention.

As can best be seen in FIGS. 5, 8A, 10, and 10A, grid head 22 includes a plurality of grid closing elements in the form of grid fingers 52 which form an array of grid chutes in a matrix corresponding to the three-by-four matrix of articles 13 in slug 15. The grid chutes, formed by four of the grid fingers, are designated generally as 54. It is preferred that there is a corner grid finger in each corner of the chute so that the finger surfaces 52*c* define a generally rectangular chute (FIG. 23). Basically, grid head 22 may be a suitable grid head such as that shown in U. S. Pat. No. 4,215,521, incorporated here by reference, with the below described modifications. It is also to be understood that grid fingers mounted on the sides of the chutes with suitable actuators, as are known in the art, may be used instead of the corner mounted fingers as illustrated. Typically, articles are lowered into such grid sets or heads from the tops of the grid fingers. In accordance with the present invention, the grid head is designed so that grid chutes 54 are open, and held open in a positive manner, so that the open grid chutes may be received over the articles, i.e. the articles enter the grid head from the bottom of the grid. For this purpose, a locking head, designated generally as 56 is provided which includes a plurality of spaced support bars 56*a* having locking elements 58 carried on the bars (FIG. 10). Locking grid 56 includes a rectangular frame 60 by which support bars 56*a* are carried. Frame 60 is affixed to grid head 24 by means of adjustable brackets 62. A compression spring 64 is affixed between frame 60 and a frame 66 of grid head 64. This causes a downward force on frame 60 as shown by arrow 65. This urges an apex portion 58*a* of locking elements 58 into a recess formed by the four upper ends 52*d* of a set of fingers 52 which form adjacent corners of adjacent chutes. This urges each finger inwardly into the corner of the adjacent chutes whereby the four fingers defining each chute are held in a chute open position for fitting over the individual articles in the slug for pick-up (FIG. 23).

In the typical grid set referred to above, a camming arm 70 is provided which opens and closes the fingers, which have perpendicular backsides 52*a*, 52*b*. Camming arms 70 engage a first backside of the fingers and include a cam 71 having converging surfaces 71*a* and 71*b*, which intersect at ninety degrees, to wedge behind a second, intersecting backside of the fingers as described in detail in the above referenced grid set patent. When the camming arm is vertical, the fingers are closed and the chute is open. When the camming arm is rotated ninety degrees or more (past center), the fingers open from their corner positions into and towards a center line 54*a* of chutes 54 to close the chutes. The past center actuation of the finger mechanism provides a positive locking of the fingers in the chute closed position for retaining the articles. Grid fingers 52 pivot about a pivot defined by a retainer ring 72 which also affixes four of the fingers 52 to lateral spacer bars 74 which are spaced across the grid head (FIG. 23), all of which may be more fully seen in the above referenced patent.

Figure 10A:
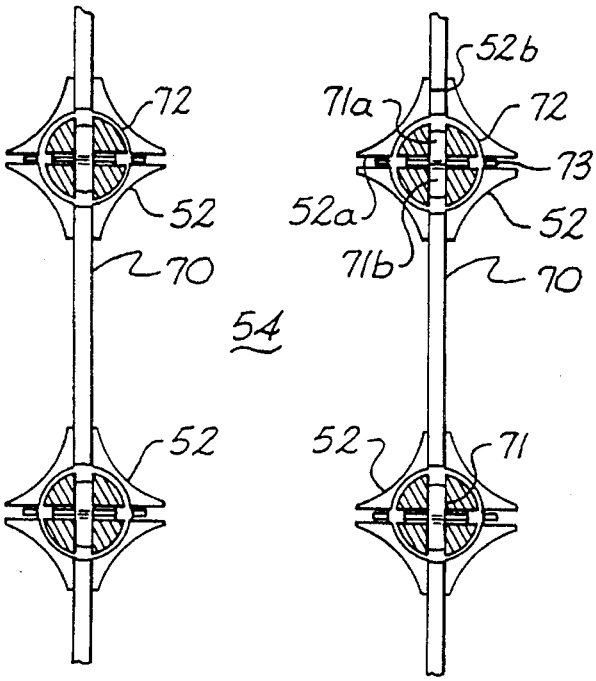
FIG. 10A is a sectional view taken along line 10A—10A of FIG. 10 illustrating a grid chute having four corners formed by fixed corner fingers according to the invention whereby the chute may be maintained open for a reliable fit over a slug.

Each chute corner is formed by two perpendicular, chute forming surfaces so that the corner fingers are maintained truly vertical and correctly positioned for fitting over articles, as can best be seen in FIG. 10A. First, camming bar 70 forms one surface for each finger. Second, there are bracing rings 73, surrounding and perpendicular to the camming bars 70, which form the second surface against which each finger is biased by locking elements 58 in the open chute position. In this position, as can best be seen in FIGS. 8A, 10, and 10A, a lower chute end 68 is provided which is open for receiving articles and which is closed for retaining articles.

Figure 6:
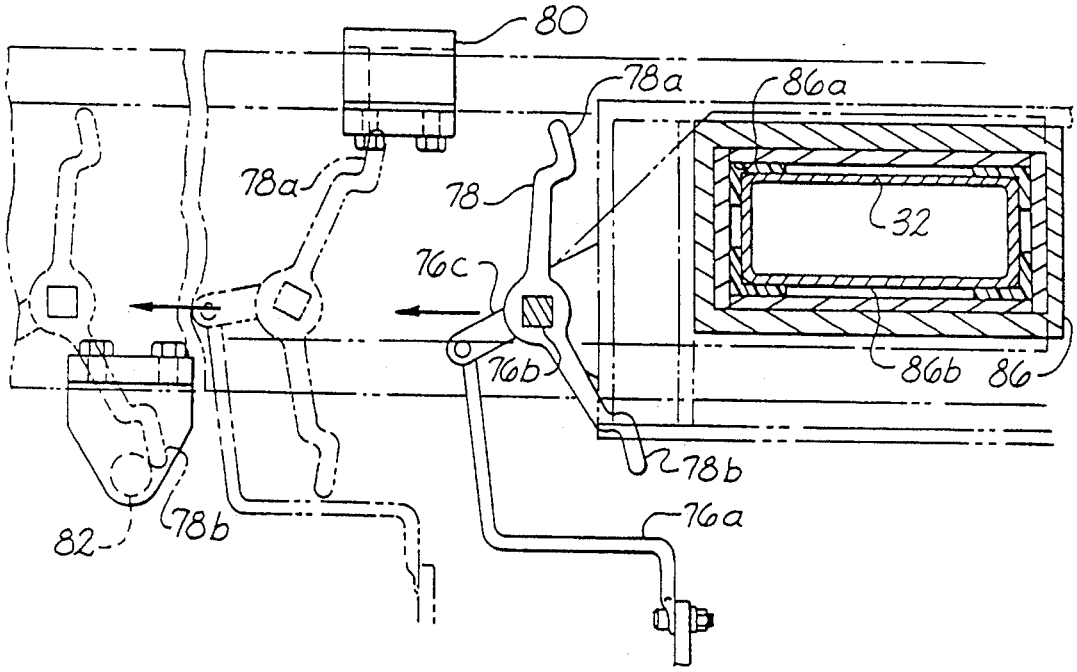
FIG. 6 is a sectional view taken along lines 6—6 of FIG. 5.
Figure 7:
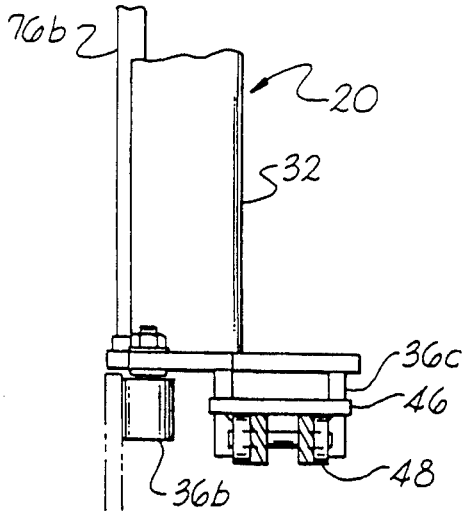
FIG. 7 is a sectional view taken along line 7—7 of FIG. 5.
Figure 8A:
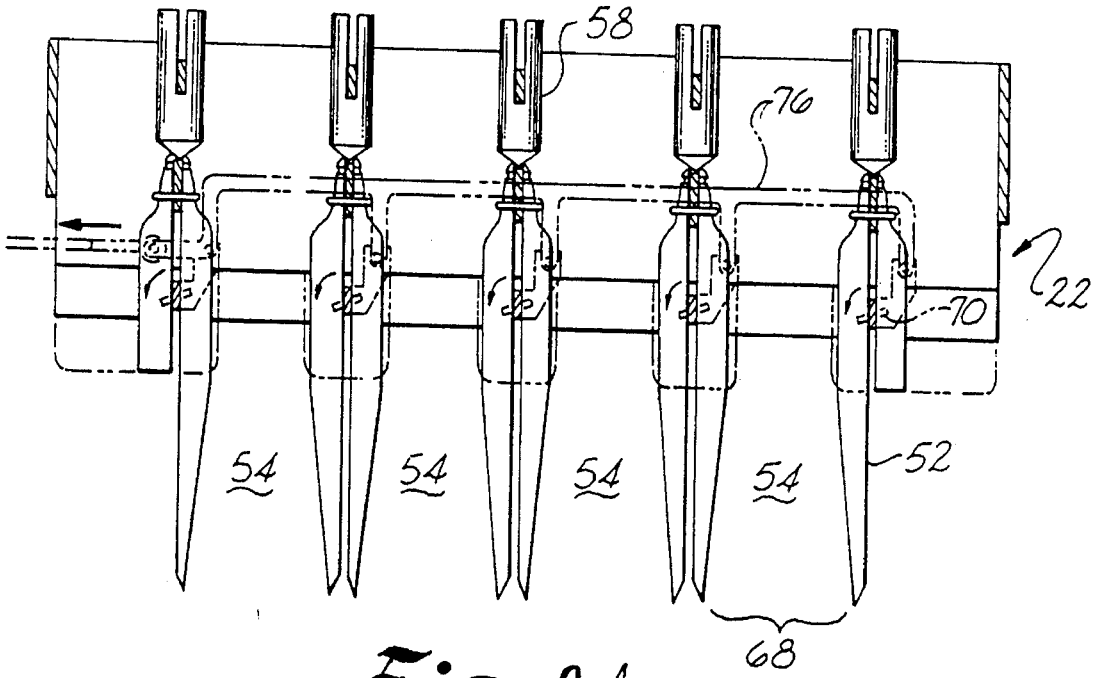
FIG. 8A is a sectional view of the grid head of FIG. 5 illustrating open grid chutes according to the invention for being place over the tops of articles contained in a slug.
Figure 9:
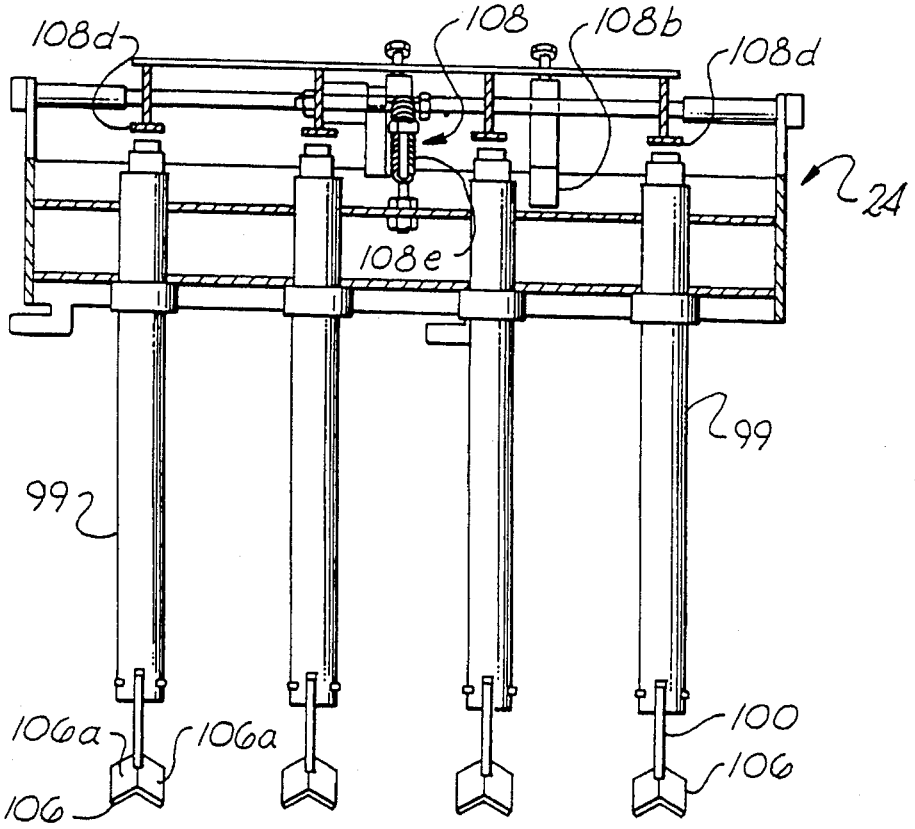
FIG. 9 is a sectional view of gripper tubes having grippers for engaging necks of articles in a continuous motion case packing apparatus and method wherein the articles may be placement packed.
Figure 8B:
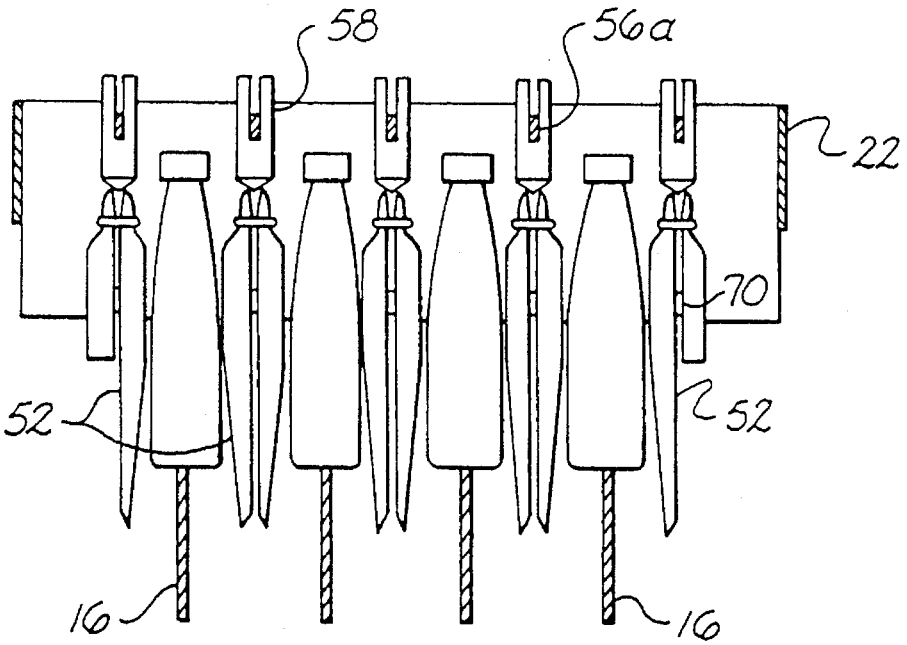
FIG. 8B is a sectional view taken across a slug pick-up station according to the invention wherein open grid chutes are received over the articles contained in the slug.
Figure 8C:
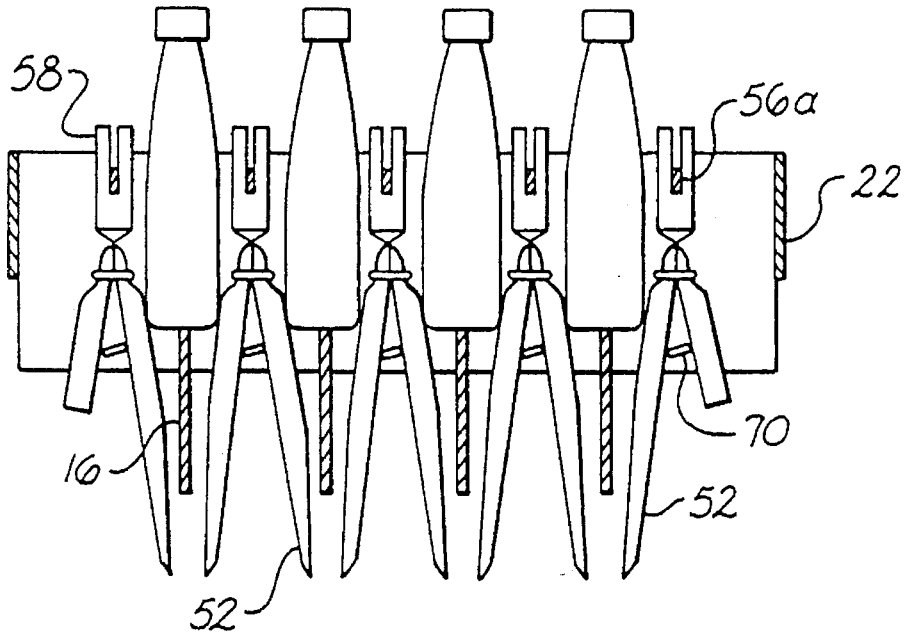
FIG. 8C is a sectional view taken across the slug pick-up station of FIG. 8B wherein the grid chutes of the grid head are closed to retain the articles in the grid chutes for transfer to a case packing station.

In accordance with the present application, as can best be seen in FIGS. 5 and 6, a grid head actuator is provided for opening and closing the grid elements or fingers 52, which includes camming arms 70 and cams 71, and a linkage bar 76 connected to the camming arms. Linkage bar 76 is connected to an actuator rod 76*a* which in turn is connected to an actuator post 76*b* by a slidable connector 76*c*. Actuator post 76*b* is rotatably journaled in connector plate 36*a* at a lower end and to connector plate 34*a* at an upper end so that it may swivel and actuate camming arms 70 to open and close grid chutes 54. This actuation takes place in response to a forked actuator 78 being engaged by certain programmed abutments. Forked arm 78 includes a first arm 78*a* and a second arm 78*b*. There is a first chute closing abutment 80 carried in the path of travel of transfer arm 20 and hence actuator arm 78*a*, and a second chute opening abutment 82 spaced downstream in the travel direction for engagement with second arm 78*b*. Both abutments may be adjusted to ensure the correct timing of the actuator in closing and opening of the grid chutes. A backup abutment may be provided for each (FIG. 2C) for redundancy to assure operation. The first abutment 80 is shown adjustably mounted to rear carriage plate 42 and second abutment 82 is shown adjustably affixed to front carriage plate 40. The operation of the grid head and actuator will be described more fully hereinafter.

Referring again to FIG. 5, it can be seen that grid set 22 rests on a rack 84 having a pair of spaced arms 84*a*, 84*b* which are affixed to a bearing block 86, as can best be seen in FIG. 4B. Bearing block 86 includes a cam roller 86*a* which rides on a first cam track 88. Rack arm 84*a* is affixed to an opposite side of bearing block 86. By this means, grid head 22 slides and reciprocates linearly on transfer arm 20 in response to the shape of cam track 88. For this purpose, as can best be seen in FIG. 6, bearing block 86 includes four corner bearings 86*a* affixed within the corners of a hollow interior 86*b* of bearing blocks 86. Transfer arm beam 32 slidably engages the bearings for relative sliding movement therebetween.

Referring now to gripper head 24, it too is slidably carried on transfer arm beams 32. As can best be seen in FIG. 4B, there is a second bearing block 90 disposed above bearing block 86 which slidably receives beam 32 in a similar construction described above with reference to bearing block 86. A rubber pad 92 is carried by a top perimeter of lower bearing block 86 to cushion the nesting of bearing block 90 on top of bearing block 86. So that the heads may be nested or stacked upon one another along their return path, and at various other stages of operation, rack arms 84*a*, 84*b* are offset wide on bearing block 86 to accommodate bearing block 90 nesting within the arms. A horizontal arm 90*a* which is wider than bearing block 90 extends across the front of the bearing block and carries a pair of vertical bars 90*b* which support a back frame 94 which supports rack arms 94*a*, 94*b*. Gripper head 24 sits in rack 94 in direct alignment with grid head 22, as can best be seen in FIGS. 4A–4C. The weights of the gripper head and grid head maintain them in their respective racks. Bearing block 90 includes a cam roller 90*c* which rides on a second cam track 96. Cam tracks 88 and 96 include plastic bushings affixed to the main frame of carriage C by means of aluminum contoured strips having the desired contour of the cam track. The plastic bushings extend part the aluminum retaining strip to engage the cam rollers of the bearing blocks.

Figures 11, 11A:
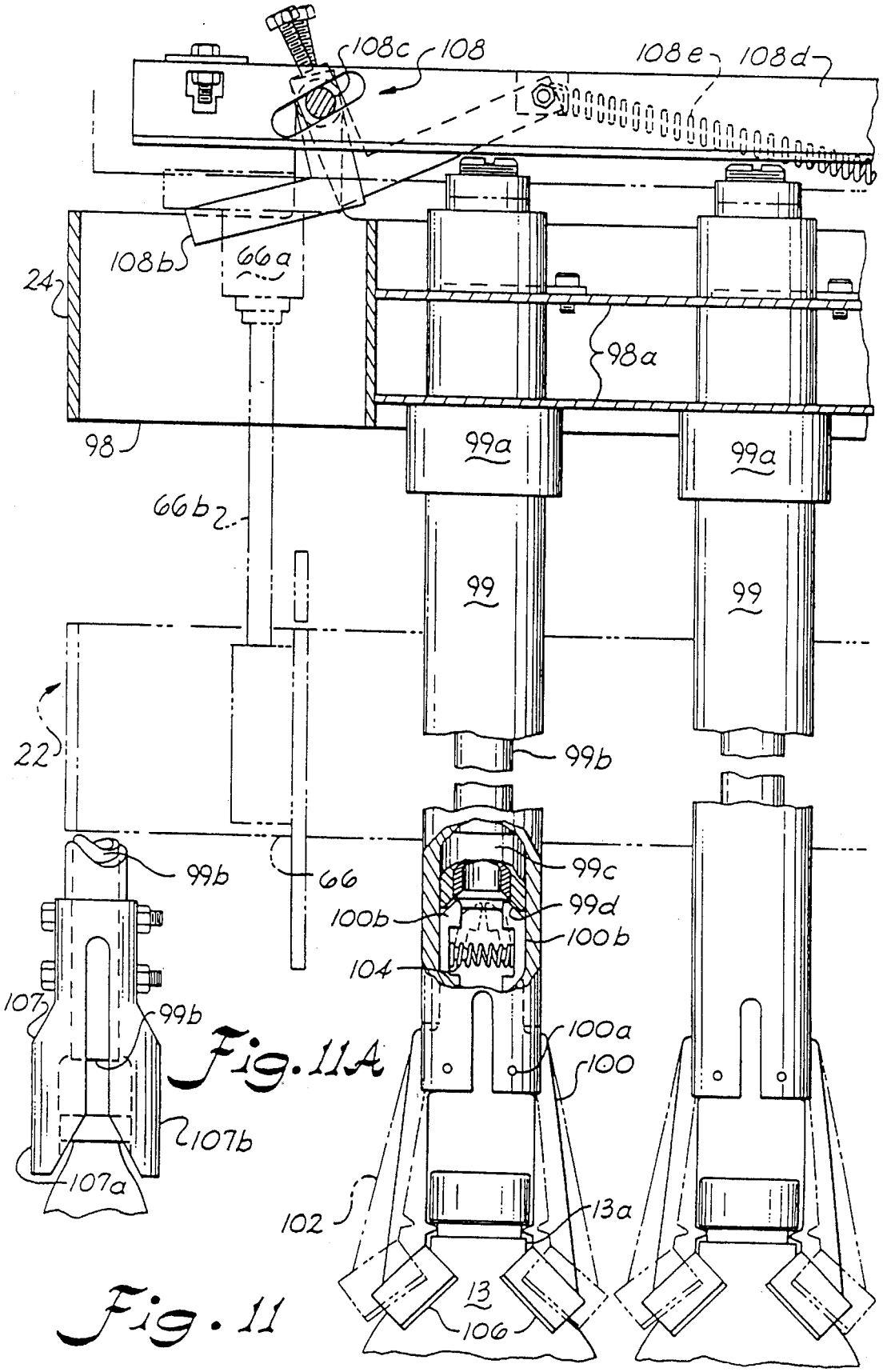
FIG. 11 is an enlarged partial section view illustrating the opening and closing of gripper elements on a gripper tube according to the invention for gripping the necks of articles conveyed on a continuous motion apparatus according to the invention.
FIG. 11A is an elevation illustrating an alternate embodiment for a gripper according to the invention.

Referring now in more detail to gripper head 24, it can be seen that the gripper head includes a frame 98 which holds an array of gripper tubes 99 affixed thereto in a manner that can best be seen in FIG. 11. Basically, gripper tubes 99 include attachment ends 99*a* affixed to frame plates 98*a* as shown. A gripper head actuator includes a reciprocating rod 99*b* carried within gripper tubes 99 is affixed to a beveled follower 99*c* having a downwardly and outwardly beveled edge 99*d*. Gripper elements 100 pivoted at 100*a* include upper arms 100*b* received within gripper tube 99. When actuator rod 99*b* is forced downwardly, beveled camming surface 99*d* forces ends 100*b* of the gripper elements inwardly to spread them apart to an open position shown in dotted lines at 102. When rods 99*b* are not actuated by downward force, a spring 104 urges gripper ends 100*b* away from each other with a sufficient force to lock opposing gripper jaws 106 about a neck 13*a* of article 13. Winged jaws 106 also provide a centering device for centering the articles in grid chutes 54 as will become apparent. It is noted that winged jaws 106 include a pair of downwardly and outwardly diverging wings 106*a* (FIG. 4A). A gripper actuator mechanism, designated generally as 108 includes a pivotal arm 108*b* which pivots about a pivot 108*c*. A fixed abutment 66*a* is shown attached to the frame 66 of grid head 22. Abutment 66*a* is affixed to a post 66*b* whose lower portion is attached to frame 66. When grid head 22 and gripper head 24 are in a nested, proximity position shown in dotted lines in FIG. 11, abutment 66*a* urges actuator arm 108*a* to the horizontal dotted line position shown. This forces an actuator bar 108*d* downwardly to engage the upper ends of actuator rods 99*d* there to move actuator head 99*c* downwardly to pinch ends 100, 100*b* inwardly to open the grippers. Thus, the gripper jaws are open when the grid head and gripper head are in the proximity position shown in FIG. 11. However, when the grid head and gripper head move apart so that abutment 66*a* comes off actuator arm 108*b*, arm 108*b* pivots to the full line position under the force of a spring 108*e* to return actuator bar 109*d* to the full line position whereupon spring 104 pushes ends 100*b* apart to close gripper jaws 106. The article pick-up and case packing operation of the gripper tube head will be described more fully below.

FIG. 11A illustrates another embodiment for a gripper element may be had which includes a resilient gripper element 107 constructed from a polymeric material, or synthetic or natural rubber. The gripper element includes resilient jaws 107*a* and 107*b* having interior ledges 107*c* which grip underneath the article head and around the neck as shown. It is not necessary to open the jaws to receive the article, and to release the article only requires downward actuation of actuator rod 99*b*. While the head 24 is referred to as a "gripper" head and the gripper elements have been illustrated as mechanical and resilient gripper jaws, it is to be understood, of course, that any element which attaches to the articles such as suction, or otherwise, may be used on the ends of tubes 99.

Slug Feeder

Figure 2B:
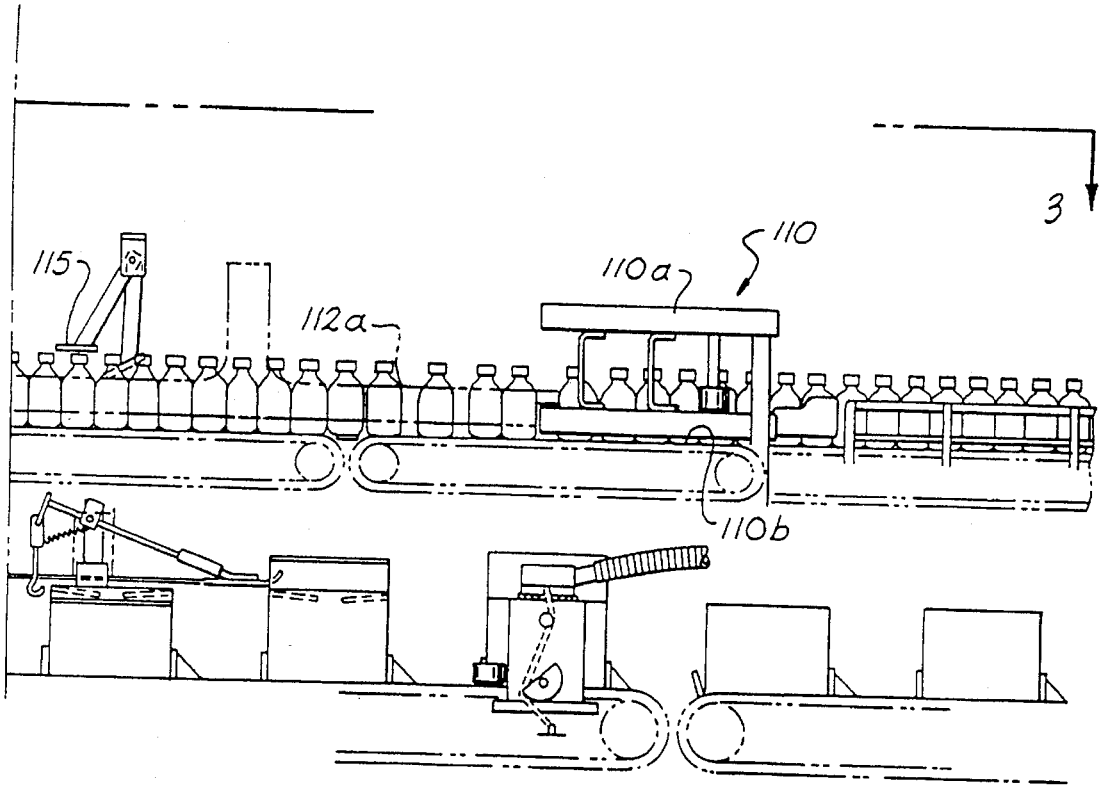
FIG. 2B is a side elevation of an infeed end of a continuous motion case packing apparatus and method according to the invention illustrating a laner for feeding articles into longitudinal lanes formed by side rails wherein the laner is disposed above a lower case indexing conveyor and flap opening station.
Figure 2C:
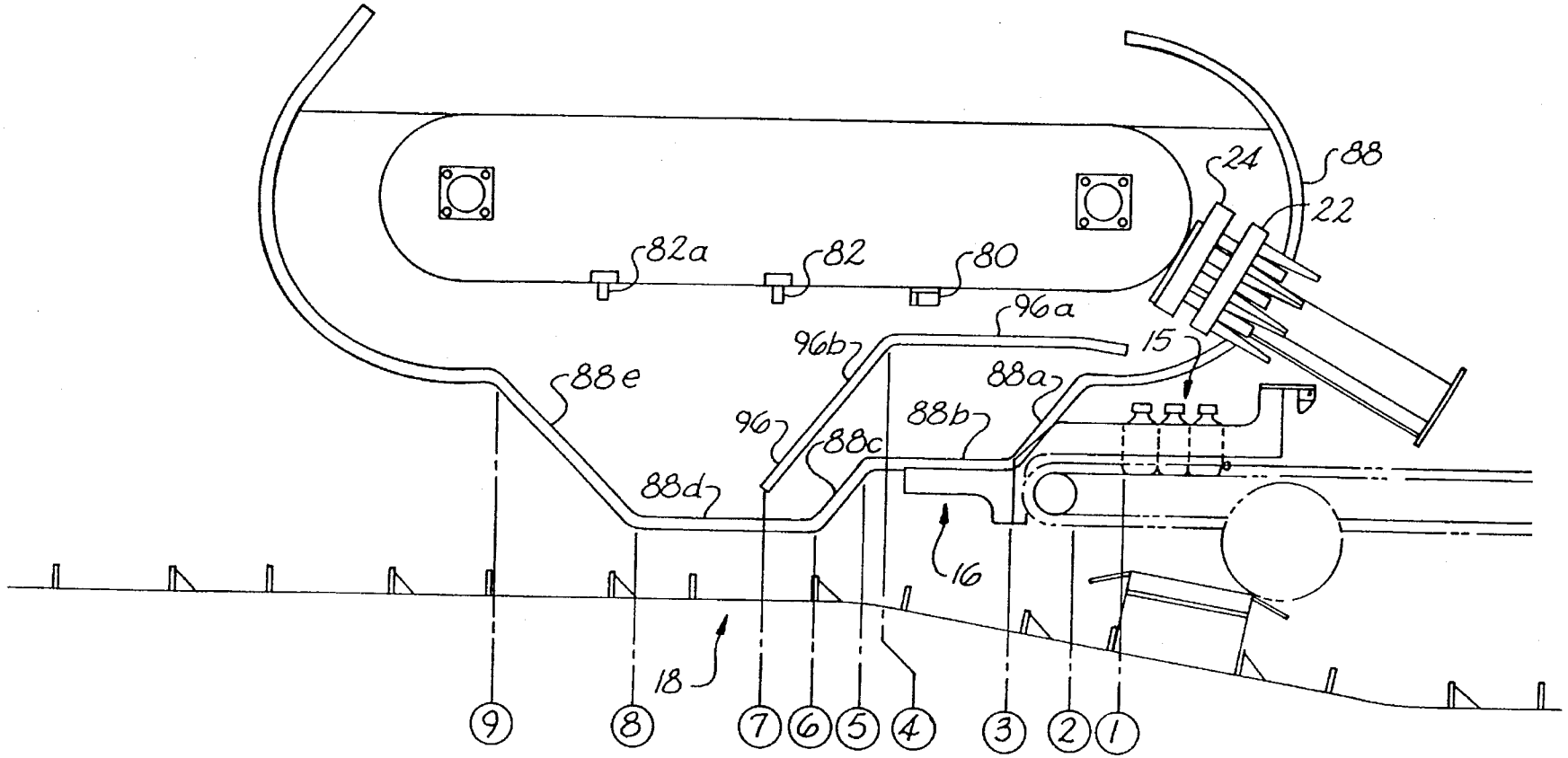
FIG. 2C is a schematic elevation illustrating a continuous motion case packing apparatus and method according to the invention illustrating the relative positions of an article transfer arm having gripper and grid heads, a slug of articles, and indexed case prior to article pick-up.
Figure 2D:
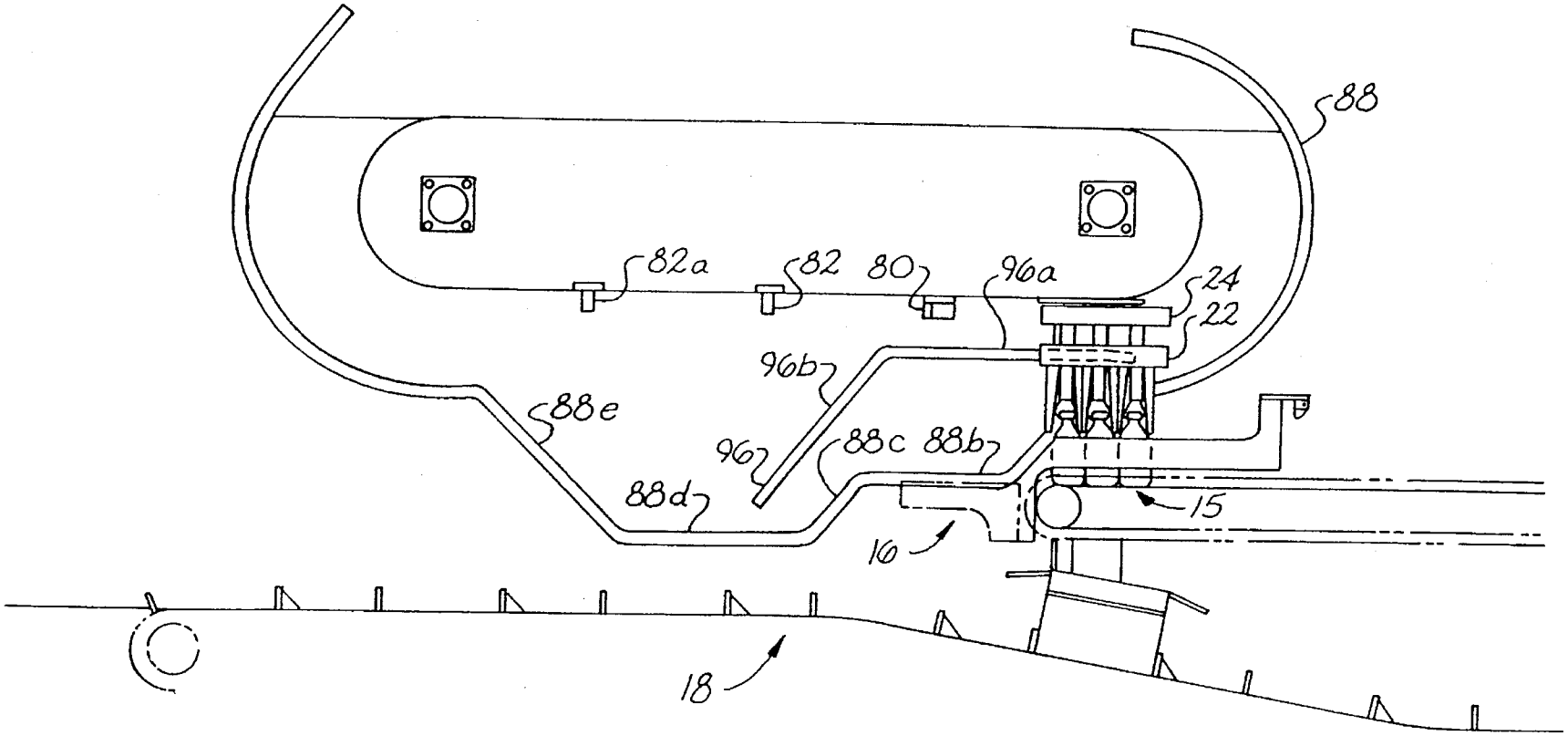
FIG. 2D is a schematic elevation illustrating a continuous motion case packing apparatus and method according to the invention illustrating the relative positions of an article transfer arm having gripper and grid heads, a slug of articles, and indexed case prior to article pick-up.
Figure 12:
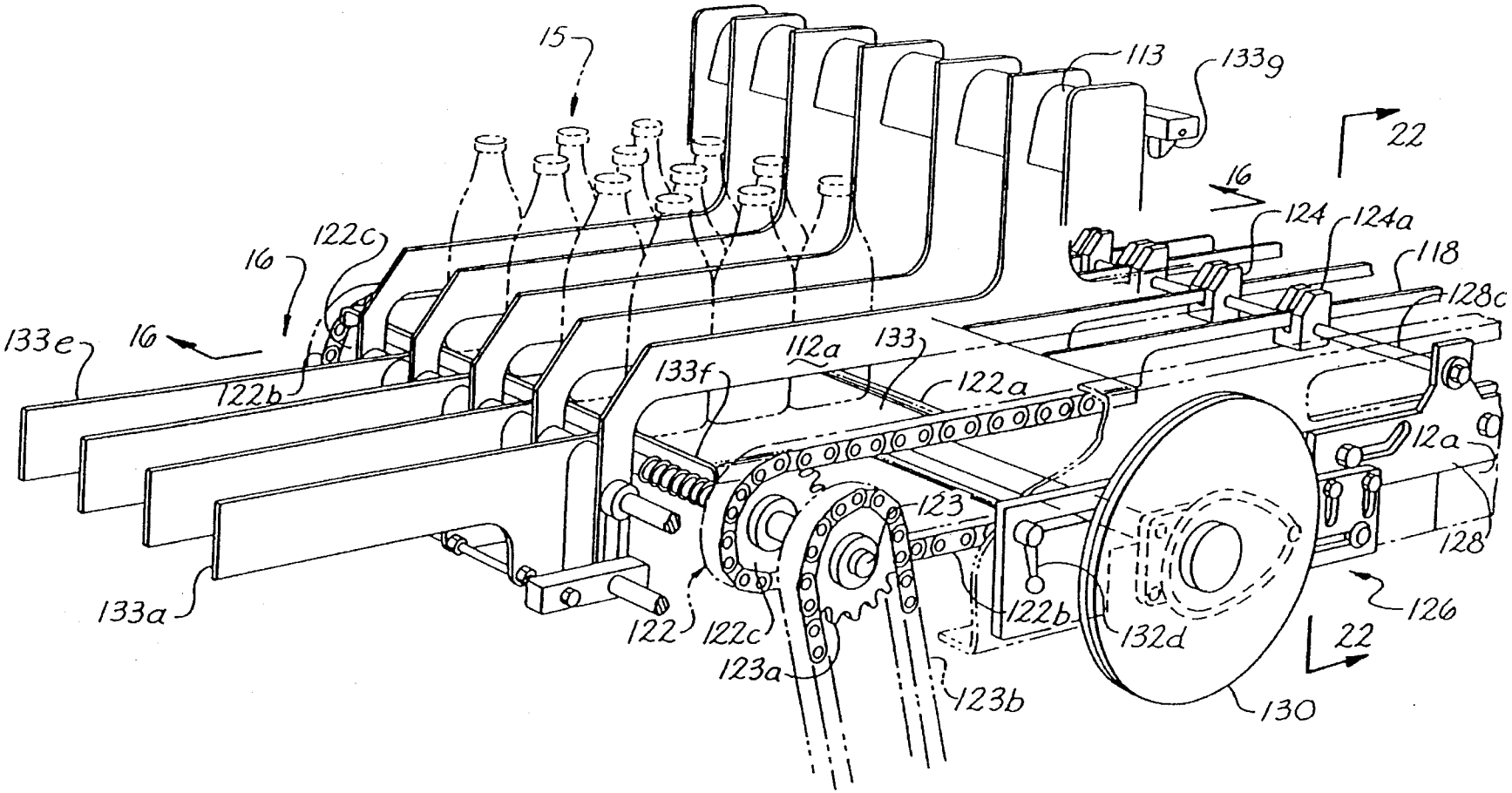
FIG. 12 is a perspective view of a slug feeder and a slug pick-up station according to the invention for use with a continuous motion case packing apparatus and method in accordance with the invention.

Slug feeder B will now be described referring to FIGS. 12, 13A–13D, 14A–14D, and 16–18. First, it will be noted that a laner assembly 110 counts the articles and directs them to a longitudinal rows 30 in order to keep the rows filled (FIGS. 2B and 3B). Any suitable laner assembly may be utilized such as that disclosed in U.S. Pat. No. 4,723,649, incorporated by reference herein. Typically, a laner includes a pivoting guide chute 110*a* which swings back and forth across a conveyor to discharge a predetermined number of articles into parallel lanes in which the longitudinal rows or articles are formed. Articles may be fed to the pivoting chute either in single file, or scrambled. As pivoting chute 110*a* moves back and forth, the articles are conveyed through the chute into the lanes by an infeed conveyor 110*b*. The lanes are defined by spaced side rails 112*a*–112*e*. In the illustrated embodiment, there are five such side rails to define four lanes since the exemplary slug is three-by-four. However, it is to be understood that any number of lanes may be utilized in conventional packers depending on the application being made. At least one lane is needed such as in the packing of large, round containers of beverages and food. The spaced side rails extend through the slug feed conveyor 10 and the slug metering section 12, as can best be seen in FIG. 3A. The lateral spacing between the side rails may be adjusted so that the number and width of the lanes may be adjusted. This may be done in a conventional manner by suspending the side rails from above on transverse bars spaced above the conveyors wherein removable spacers 113 are fitted over the bars to space the side rails to provide the desired spacing (FIG. 12).

In accordance with the invention, a variable speed conveyor 114 is utilized in slug conveyor section 10. Any conventional conveyor belting may be utilized driven in an endless manner. A counter finger 115 may be provided for each lane to count the number of articles in the lane. In the event that an article is not counted, the laner may be directed to direct an additional article to that lane where the article is missing.

Referring now to slug metering section 12, slug conveyor 114 terminates at the slug metering section (FIG. 3A) and feeds articles to the slug metering section over a transition plate 116 (FIG. 2A). The articles then move over a support floor defined by a plurality of adjustable bottom skids 118 which are centered in the lanes. As can best be seen in FIGS. 17 and 18, the bottom skids are adjustable so that they may be made to correspond to the side rail spacing when adjusted. For this purpose, an adjustable skid mechanism includes transverse rods 120 (a drive shaft to be described later) which are provided removable spacer blocks 120*a* are fitted between adjacent bottom skids 118. The skids may be spring loaded to force them inwardly against the spacer blocks.

Slug metering section B includes a revolving flight bar mechanism 122 which provides a revolving abutment in the form of flight bars 122*a* for separating the continuous stream of articles into discrete slugs. It will be noted that flight bars 122*a* are spaced at an interval "L" apart. The flight bars revolve upwards to divide the articles, and engage the last article 13*c* in a slug for conveying the slug of articles forward through the metering section (FIG. 14D). The flight bars are carried on an endless chain 122*b* driven by a drive sprocket 122*c* and various other idler sprockets 122*d*. Drive sprocket 122*c* is driven by a shaft 123 which in turn is driven by a drive sprocket 123*a*. Drive sprocket 123*a* is driven by a drive chain 123*b* in synchronism with the transfer arms 20 and index case conveyor chain 138, to be described in conjunction with FIG. 15.

Figure 16:
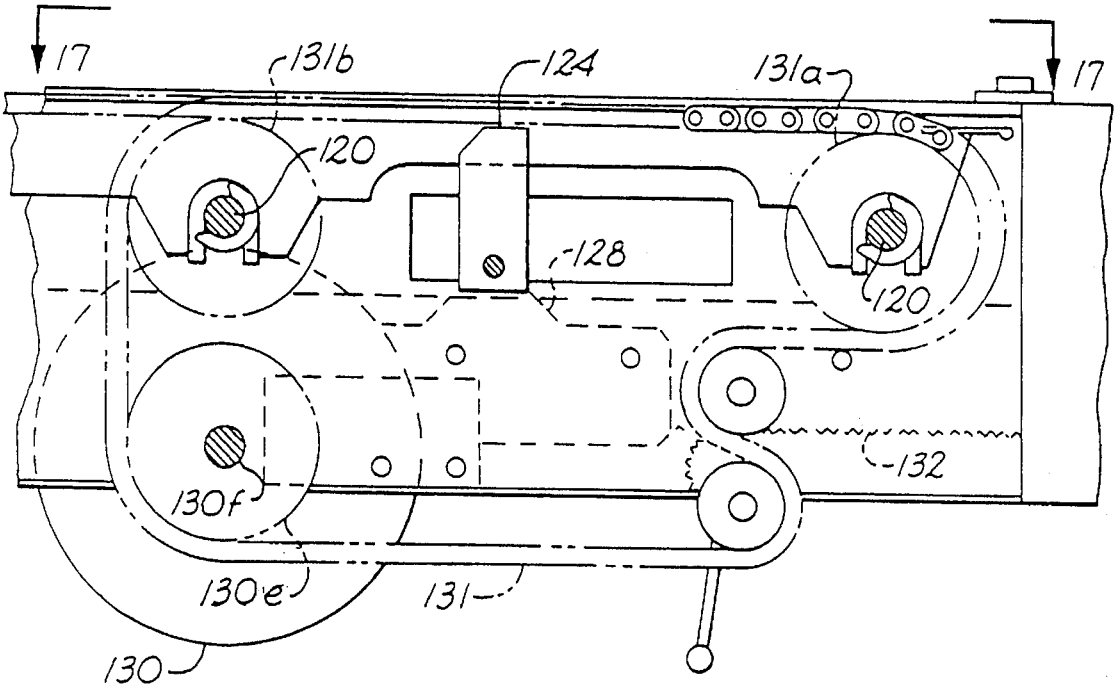
FIG. 16 is a sectional view taken along line 16—16 of FIG. 12.
Figure 17:
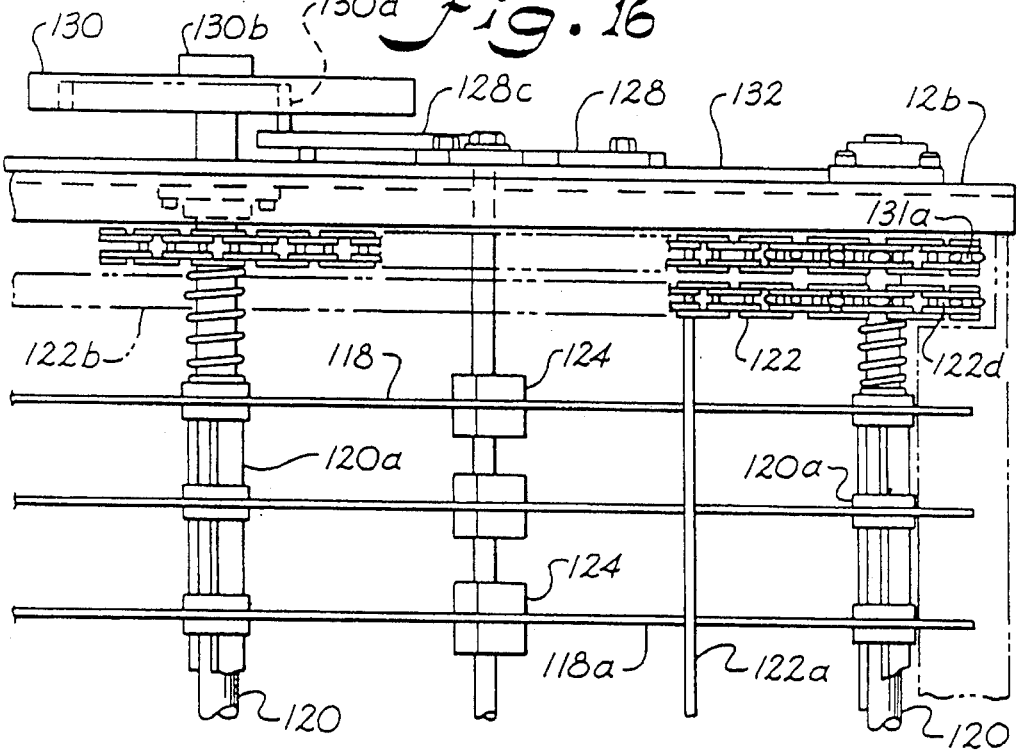
FIG. 17 is a sectional view taken along line 17—17 of FIG. 16.
Figure 18:
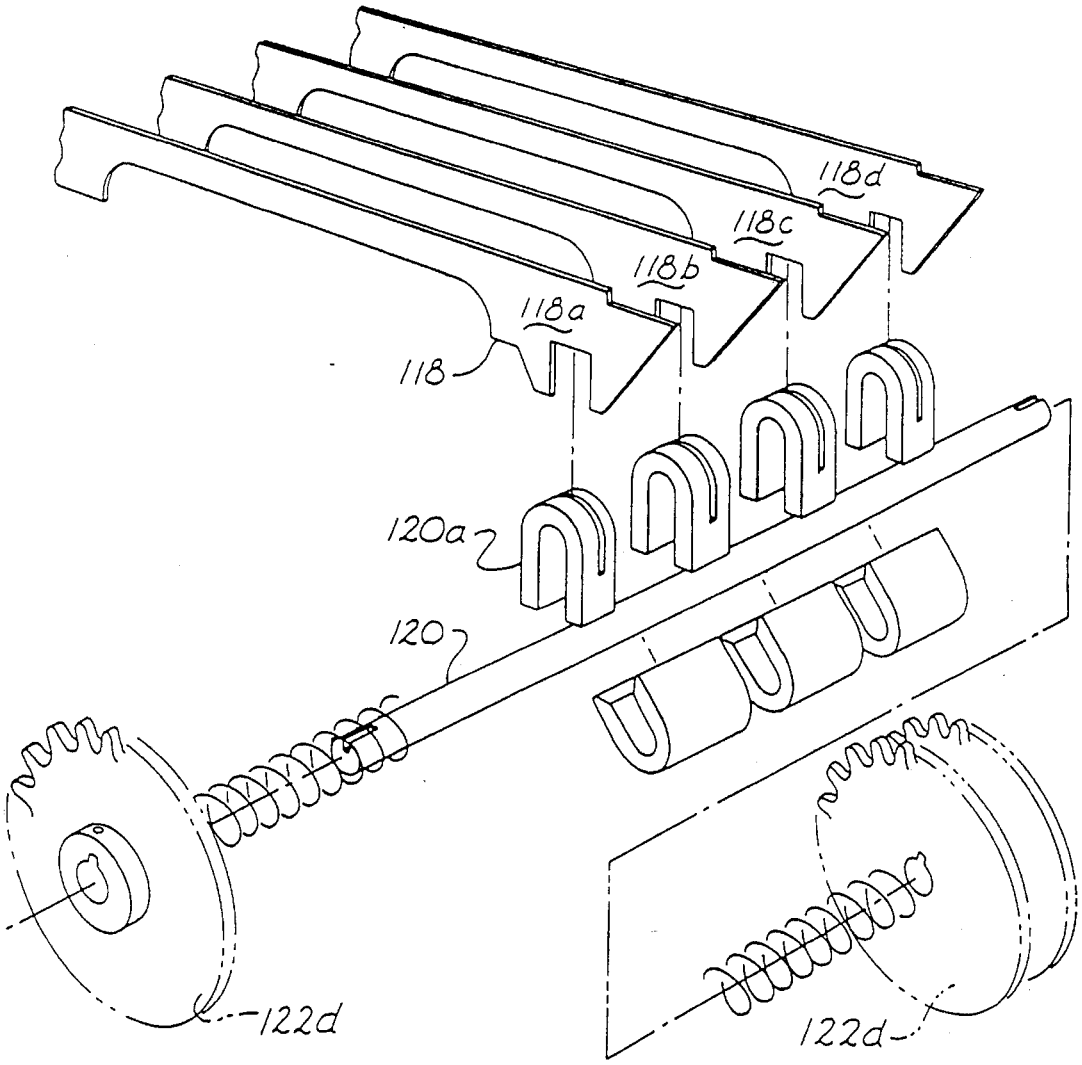
FIG. 18 is a perspective view illustrating adjustable lanes and bottom support skids for a slug metering section according to the invention in order to adjust the widths and number of lanes in a slug feeder.

As can best be seen in FIGS. 13A–13D, slug metering section B further includes an adjustable slug metering mechanism which includes a metering block 124 disposed in centrally in each lane which moves in and out of the conveyance path of the articles in a cyclic manner to meter the number of articles in the slug. A metering distance d1, defined between metering block 124 and flight bar 122*a*, determines the number of articles in the row and the size of the slug (FIG. 14D). There is a drive mechanism 126 for driving slug metering block 124 in cyclic movements in and out of the conveyance path independent of the revolving flight bar mechanism. Drive mechanism 126 includes a cam plate 128 having a pair of drive cam slots 128*a* and cam pins 128*b*. There is a drive rod 128*c* (FIG. 12) carried by cam plate 128 on which metering blocks 124 are carried. The metering blocks include a slot 124*a* which receives bottom skids 118 so that the metering blocks reciprocate in and out of the conveyance paths of articles supported on the skids centered in the lane (FIG. 12). Cam plate 128 is affixed to a drive plate 128*c* by means of two bolts 128*d*. Drive plate 128*c* includes a drive slot 128*e* which slides on at least one drive pin 128*f*. Finally, the drive mechanism gets its reciprocating drive from a timing cam wheel 130 having a timing cam slot 130*a* formed in the wheel. Referring to FIG. 16, it can be seen that timing cam 130 is driven off of the same drive which drives flight bar chain 122*b* by means of a drive chain 131 connected to a drive sprocket 131*a*, idler sprocket 131*b*, and timing cam drive sprocket 130*e* affixed to drive shaft 120 which is also affixed to timing cam shaft 130*f*. Drive sprocket 131*a* is driven off of shaft 120 to which driven sprocket 122*d* of the revolving flight bar mechanism is attached.

In an advantageous embodiment of the invention, the drive mechanism just described for metering blocks 124 is mounted on a movable carrier plate 132 which includes a gear rack 132*a* which meshes with a gear 132*b* that is rotatable by a handle 132*c*. Carrier plate 132 may be affixed to each side frame 12*a* and 12*b* of the slug metering section by spaced lock bolts with handles 132*d* extending through adjustment slots 132*e*. By loosening lock bolts 132*d*, the carrier plate may be shifted left and right to vary the distance d1 between the metering block and the flight bars. In this manner, the size of the slug may be advantageously varied, or the metering section may be adjusted to handle different sized articles regardless of the slug size. This is a highly important advantage of the adjustable metering mechanism and slug metering section of the present invention. Previously, the changeover of slug size or container size required much time and effort in changing out the drive chain and other parts of the metering section to which divider fingers were fixed. When the distance d1 between the metering block and flight bar is changed, the timing cam 130 must also be adjusted in its relative position to timing cam drive shaft 130*f*. For this purpose, timing cam 130 is mounted on drive shaft 130*f* by an adjustable coupling, designated generally as 129, between the timing cam wheel and the shaft, as can best be seen in FIG. 24. The timing cam wheel may be manually turned so that the relative positions of the timing cam slot 130*a* L and a follower pin 130*d* may be adjusted and the timing of the metering blocks and their cyclic motion is correct for the new distance d1. It is noted that follower pin 130*d* is affixed to drive plate 128*c* and received in camming slot 130*a*. As illustrated, adjustable coupling 129 includes a female spline 129*a* formed in an end of shaft 130*f*, and a male spline 129*b* formed on the end of a stub shaft affixed to timing cam 130. There is an enlarged bore 129*c* formed in shaft 123 behind female splines 129*a* that receives the male splines 129*b* as a threaded rod 129*d* is threaded into a threaded hole 129*e* by manual rotation of knob 130*b*. In this condition, the timing cam 130 may be rotated relative to shaft 130*f* to vary their relative positions. This sets the timing cam in the correct position for the new metering distance d1 and slug size. This can be done by visually setting the cam wheel at the same position relative to pin 130*d* or using indexing indicia when provided as illustrated. The threaded rod is then backed off bringing the male and female splines back into driving engagement with each other.

Thus, it can be seen that the metering block is reciprocated under the drive of the timing cam which is driven in synchronism with the flight bar chain and entire packer. The cam plates include a straight cam slot and a vertically inclined cam slot. The meter block moves longitudinally when the cam pins are in the straight portion of the cam slots. This moves the metering block longitudinally. When the cams are in the angled slots, the metered block slides up and down. The timing cam controls the timing of the meter block movement.

Figure 13A:
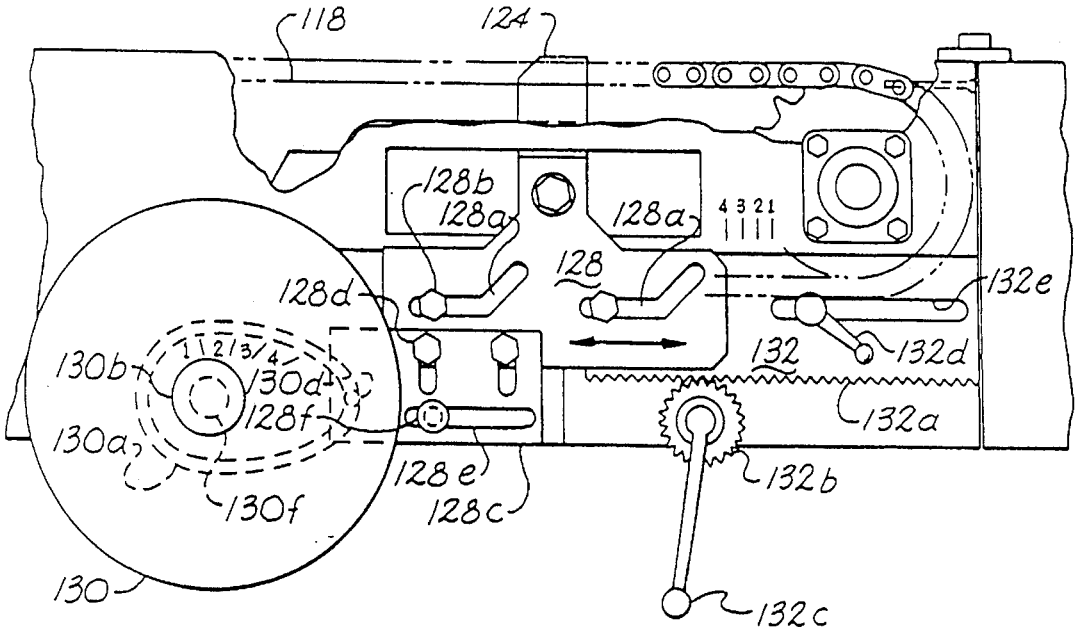
FIG. 13A is a front elevation of an adjustable metering and drive mechanism for varying the number of articles formed into a slug according to a slug feeder of the invention wherein a metering block is illustrated in a first reciprocating position.
Figure 13B:
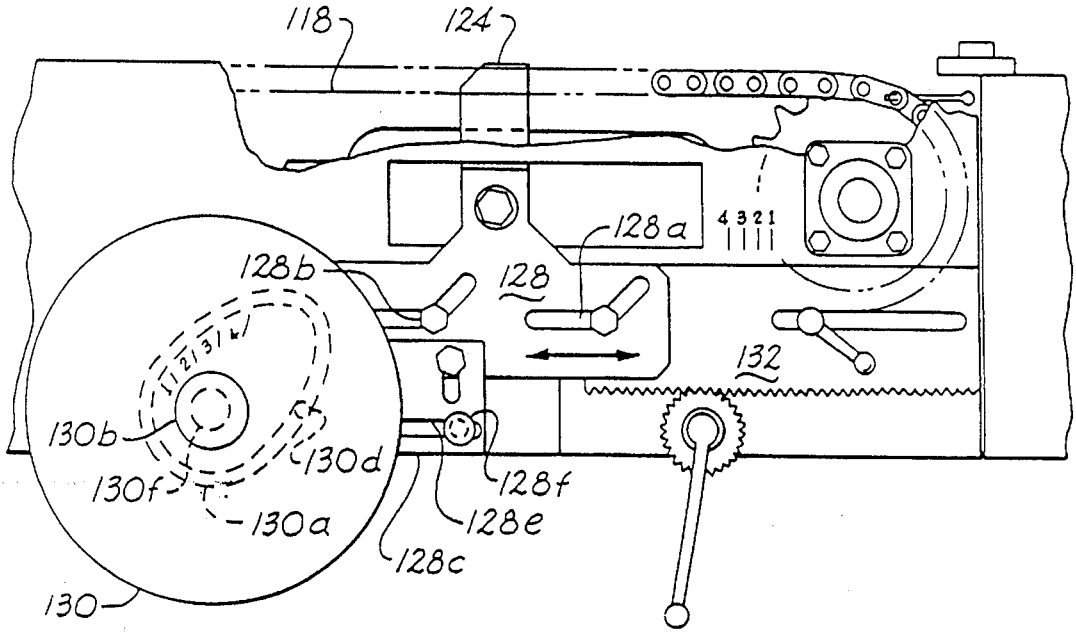
FIG. 13B is a front elevation of an adjustable metering and drive mechanism the metering block is in a second reciprocating position.
Figure 13C:
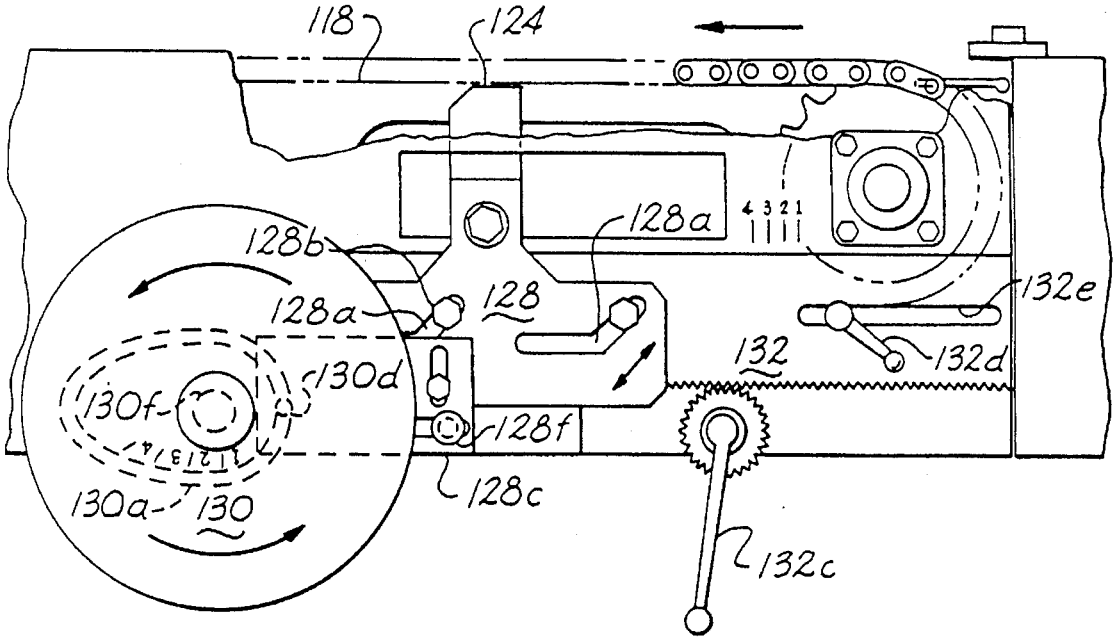
FIG. 13C is a front elevation illustrating an adjustable metering and drive mechanism carrier for an adjustable metering device according to the invention wherein the metering block is in a third reciprocating position below the level of support skids on which rows of articles are conveyed.
Figure 13D:
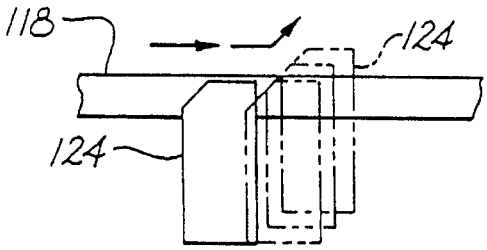
FIG. 13D is a schematic view of the cyclic, reciprocating path of the metering block of FIGS. 13A—13C.

The cyclic movement of metering block 124 will now be described by referring to FIGS. 13A–13C. In FIG. 13A, the metering block is to the right and up, extending above the surface of the bottom skids to abut a front a first article 13*a* in the row of articles contained in the slug. In FIG. 13B, metering block 124 is moved to the left and up. In FIG. 13C the metering block is to the left and down, i.e it has dropped below the bottom skid 118. In the position of FIG. 13B, the articles are conveyed past the metering block forward to the slug pick-up station 16 (FIG. 12). Prior to reaching the slug pick-up station, the articles are conveyed onto a support plate 133*f* making their entrance onto a plurality of pick-up blades 133*a*–133*e* smooth. An article counter mechanism 133*g* may be utilized to shut down the packer in the event that certain conditions exist in the counting of articles. For example, if three articles are not counted in the correct position in the slug, that is an indication that a bottle may be lying down in the lane, or missing, which could cause a significant malfunction condition at the slug pick-up station, requiring packer shut down to be described in conjunction with FIG. 15.

Figure 14A:
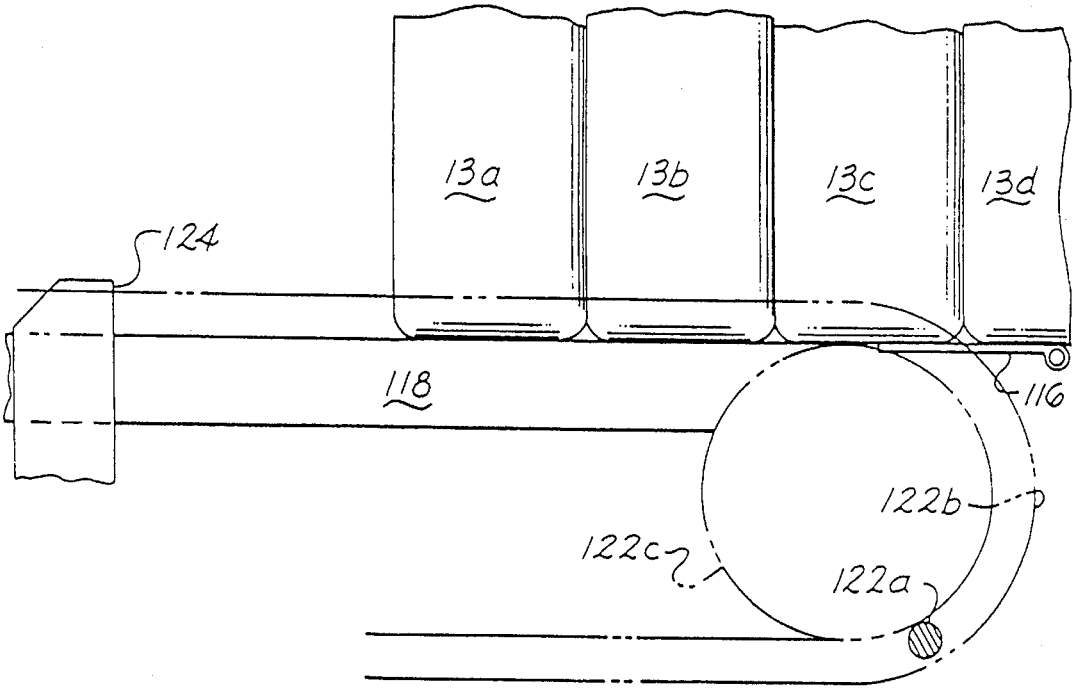
FIGS. 14A–14D are a series of elevational views illustrating the dividing of a continuous flow of articles into slugs of articles in the slug metering section according to the invention wherein the slug contains a prescribed number of articles.
Figure 14B:
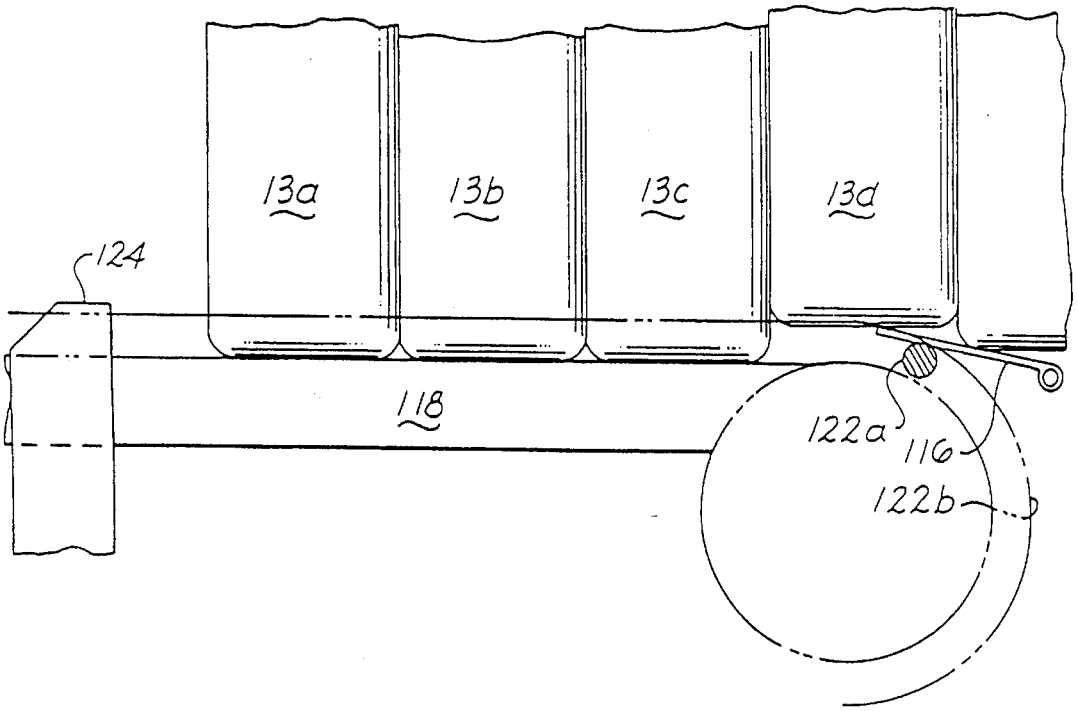
Figure 14C:
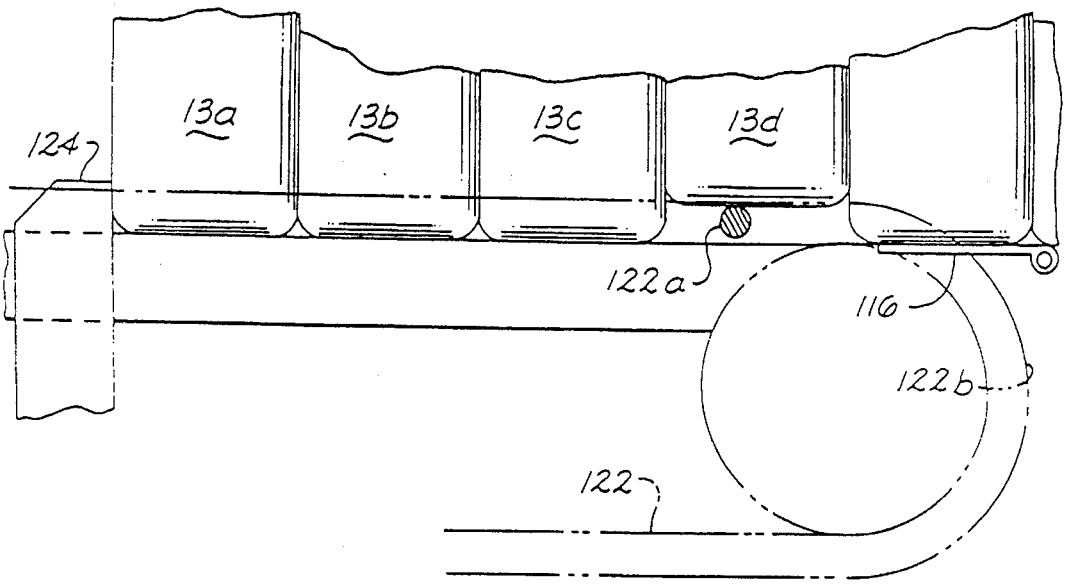
Figure 14D:
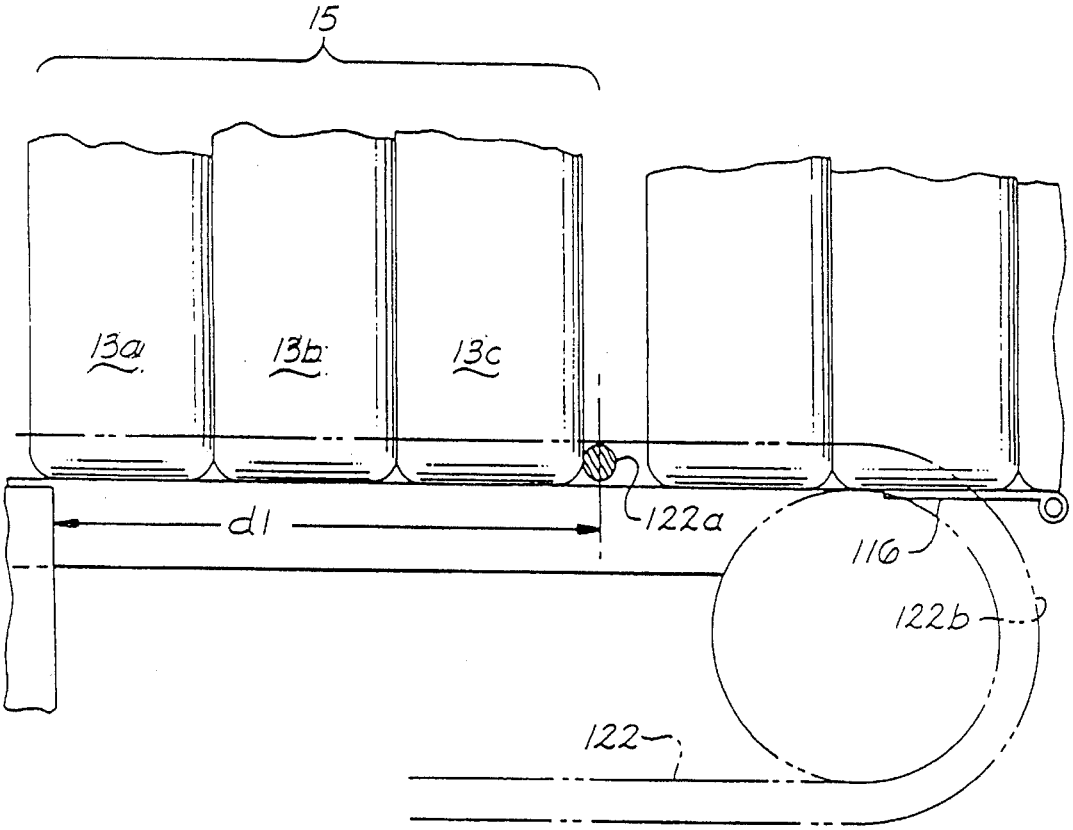

Referring to FIGS. 14A–14D, the operation of the slug metering section will now be described. In FIG. 14A, articles 13 are conveyed by the slug feed conveyor onto the bottom skids 118 of the slug metering section. Regardless of the number of lanes or rows, in each row, the first article in the slug is 13*a*, the second articles is 13*b*, and the last article is 13*c*. The first article in the next slug will be 13*d*. The articles continue to be fed at a desired speed by variable speed slug conveyor 114 onto the support skids. In FIG. 14B, the metering block is up and the flight bar begins to revolve up to divide the articles. The articles are still fed at speed which keeps the articles in contact and together as shown. In FIG. 14C, metering block 124 is up and first article 13*a* engages metering block 124. At this time, as determined by distance d1, flight bar 122*a* rises underneath article 13*d* to divide the continuous flow of articles. It will be pointed out that as long as metering block 124 is up, articles 13 will be conveyed at a sufficiently fast speed by conveyor 114 to maintain the articles in contact, as shown. As metering block 124 begins to drop, as can best be seen in FIG. 14D, slug feed conveyor 114 will momentarily slow down so that the slug 15 is quickly conveyed away by the revolving flight bar, leaving article 13*d* behind, and forming a separated slug of articles, with a gap between the next slug. It is important to note that a fast conveyor speed of conveyor 114 will keep articles 13 snugly against each other as long as metering block 124 is up. This enables flight bar 122*a*, which is above the bottom surface of the articles to lift up first article 13*d* in the second slug being formed and tilt it rearwardly to divide the articles into slugs. The relative speeds of the revolving flight bar, metering block, and slug conveyor may be controlled using any suitable arrangement, such as that shown in conjunction with FIG. 15. Transition plate 116 facilitates transfer from the slug feed conveyor to the bottom skids.

Case Indexing and Flap Opening

Figures 21, 24:
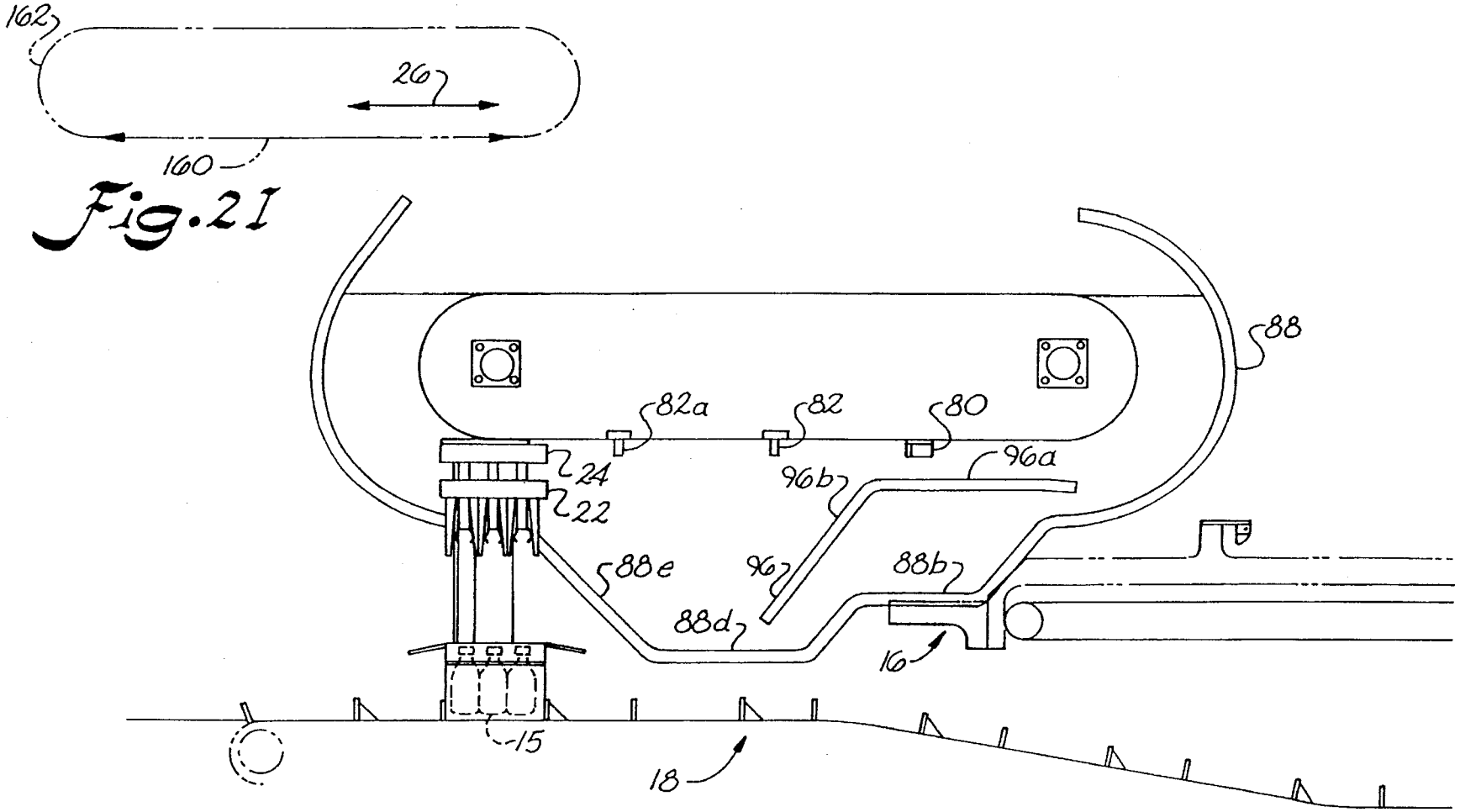
FIG. 21 is a perspective view illustrating a flap unfolding station for continuously unfolding the flaps of indexed cases being continuously conveyed on a continuous motion case packing apparatus according to the invention.
FIG. 24 is a perspective view with parts separated of an adjustable timing cam coupling for an adjustable metering block mechanism according to the invention.

As can best be seen in FIGS. 2A and 21, a case indexing station/conveyor D is disposed vertically below laner 14 and slug feeder B, and the conveyor continues through case packing station 18. Empty cases, with or without partitions are fed into and indexed at the station. The indexing conveyor includes a driven belt conveyor 136 having two spaced belt runs 136*a*, 136*b* with a center drive chain 138 which is separate and independent. Drive chain 138 carries a plurality of case engaging dogs 138*a* for conveying indexed cases to the case packing station. There is an indexing block 140 carried between the belt runs. The indexing block holds the cases until a first drive chain dog comes up in front of the case. The index block then releases the case. The case is conveyed up against the front dog and then a second, back dog comes up on the chain and engages the back of the case. The case is then held between the front and back dogs of the chain and conveyed through the case packing station. The cases are fed to belt conveyor 136 by a standard roller conveyor (not shown). For details of a suitable case indexing system, reference may be had to U.S. Pat. No. 3,986,321, incorporated herein by reference.

The indexed cases may be with or without flaps. If the indexed cases have flaps, a suitable flap opening station may be provided. For example, a flap opening station, designated generally as F, may be provided as shown in FIG. 21. Flap opening station F may include a pair of suction heads 140*a*, 140*b* which pivot from a vertical to a horizontal position under the control of a suitable reciprocating drive arrangement shown to include a cam 141 which rocks 180 degrees and drives the suction head through a chain 141*a*. In the horizontal position, suction is applied and major flaps 142*a*, 142*b* of a case 142 are opened to a vertical position. Next, the case with major flaps held vertical is conveyed underneath a horizontal plow 144 having diverging wings and diverging sides. The diverging plow sides fold the vertical flaps over from the vertical position to a horizontal position. The horizontal flaps are engaged by guide wires 146 on both sides of the plow which hold the major flaps horizontal. Next, the case is conveyed underneath a suspended pivot finger 148 with a hook end 148*a* which engages a rear flap 142*c*, and folds it open to a horizontal position. Next, a rocker arm 150 having a freely pivoting pivot finger 150*a* reciprocates and engages a front minor flap 142*d* and opens it horizontal. Pivot finger 150*a* pivots freely in a counter-clockwise direction so that on the return stroke of the rock arm, the pivot finger returns to a home position in which it is generally vertical. After front minor flap 142*d* is folded horizontal, a reciprocating, horizontal wiper arm 152 pivots forward to wipe over the rear and front minor flaps to ensure they are horizontal before they enter a center angle arm 154 which holds the flaps horizontal. A middle guide wire 154*a* continues to hold the flaps horizontal as indexed cases move continuously through the conveying process. Outside guide wires 146 and center wire 154*a* hold the flaps open for case packing through the case packing station. A suitable drive and control arrangement may be provided for the above described flap opening elements as, for example, disclosed in U.S. Pat. No. 4,587,792.

As can best be seen in FIG. 15, a synchronized drive arrangement is provided for driving carriage C, slug feeder B, and case indexing conveyor D in synchronization and at the same speed so that the article pick-up heads, slugs, and cases are conveyed in intervals "L" for accurate timing of slug pick up and deposit. There is an electric drive motor 160 which drives a system drive shaft 162 through a pulley 162*a* and clutch 164, which may be any suitable electromagnetic clutch for starting and stopping the case packer operation. Clutch 164 may be actuated and deactuated manually, and in response to a controller 165. There is an upper gear box 166 and a lower gear box 168 driven by drive shaft 162. Upper gear box 166 drives top carriage chain 38, and lower gear box 168 drives the lower carriage chain 48 through a drive sprocket 48*a*, and drives indexing conveyor chain 138 through a common drive shaft 170 and drive sprocket 172.

Revolving flight bar mechanism 122 is driven through drive sprockets 123*a* and 122*c*, which are driven off of drive chain 123 and shaft 123 (FIG. 12). Drive chain 123 is driven off of a indexing conveyor chain and shaft 138, 170*a* in unison therewith, through a drive sprocket 138*b*. The drive for metering block mechanism 126 has been explained previously in conjunction with the slug feeder. Variable speed slug feed conveyor 114 is driven by a variable speed motor and controller 114*a* as described in the operation section below. A conventional safety clutch 172 is provided through which the slug feed conveyor and revolving flight bar are driven. If there is a bottle jam, safety clutch will sense this condition and kick out to stop the slug feeder instantly. A signal is also sent to controller 165 to stop the packer. All of the sprockets shown are affixed to the shafts in a conventional manner such as a spline or the like.

It is also noted that a programmable limit switch (PLS) 174 may be provided for use with one example of a controller for the apparatus, and is driven off of shaft 170*a* and clutch 172. PLS 172 provides sequencing of several events over the cycle interval "L" in order that several control functions may be had as described above. The PLS is divided into 300 increments so that the interval "L" is divided into increments of 0.1 inches for the example where "L" is thirty inches. At prescribed increments, or ranges of increments, certain control functions may be looked at. For example, signals from photo cells (not shown) positioned to detect the correct position of an indexed case on conveyor 138 may be processed by controller 165 over a desired increment range to assure that the case will be in a correct position a the case packing station. Photo cells may also be positioned over the cases to look into the cells and detect whether all cells are empty, a flap is closed, or a case is missing. There should be a case every 30 inches or cycle of the PLS. In addition, the PLS is used to vary the speed of slug feed conveyer 114. That is, over a desired increment range, the conveyer is speeded up to keep articles in tight contact in the slug metering section while the metering block is up during slug formation, as described above. Afterwards, the conveyer is reduced in speed to that of the flight bar mechanism or slightly slower. Signals from the article count of sensor 117 in lanes 30 may be looked at over an increment range prior to the slug reaching the slug pick-up station. If three bottles are not counted in their correct position, known by the PLS, a signal is generated and sent to the controller. In the case of any of the above events, signals may be transmitted to controller 165 to deactuate clutch 164 and stop the packer. Controller may be any programmable controller or computer, the provision of a which would be well within the purview of a skilled artisan in the control art, having been taught the principles of the invention.

Operation

Figure 2E:
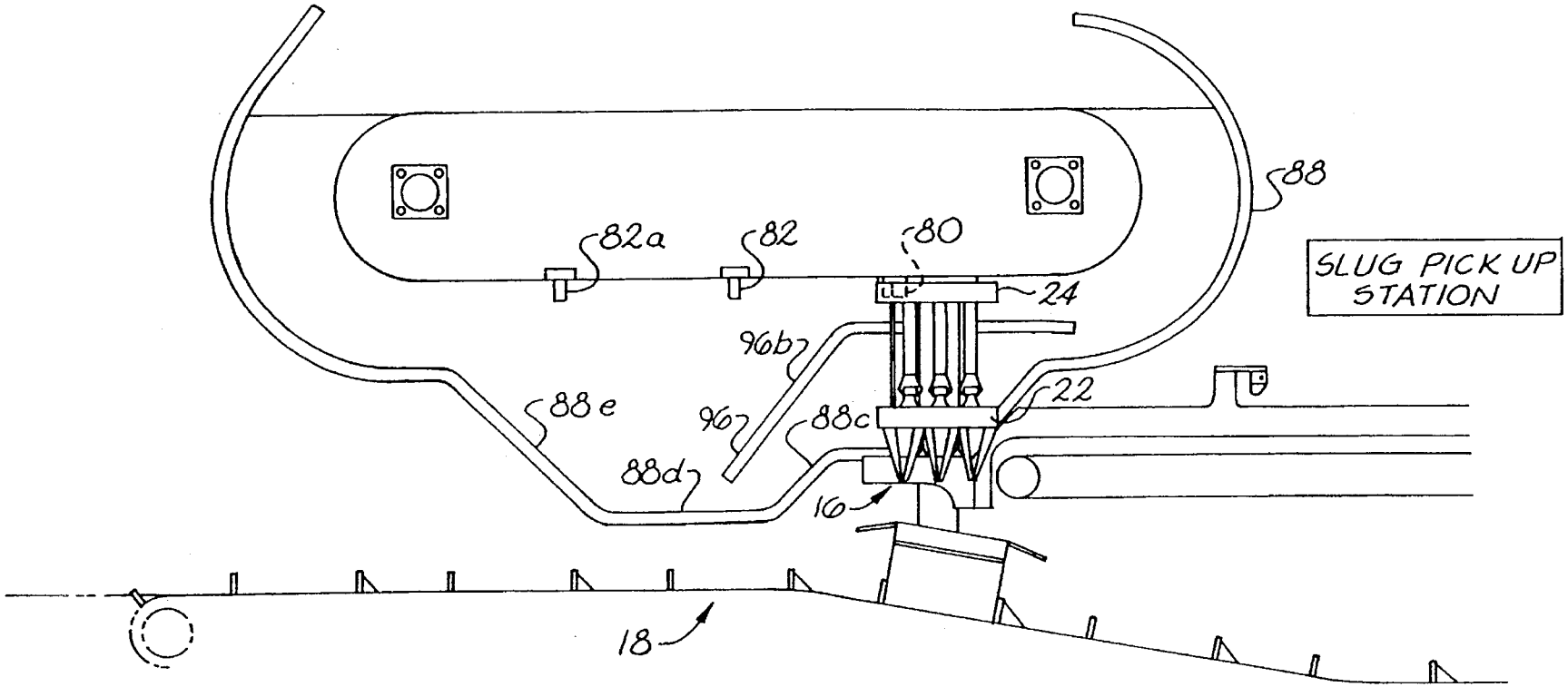
FIG. 2E is a schematic elevation illustrating a continuous motion case packing apparatus and method according to the invention illustrating the relative positions of an article transfer arm having gripper and grid heads, a slug of articles, and indexed case at a slug pick-up station.
Figure 2F:
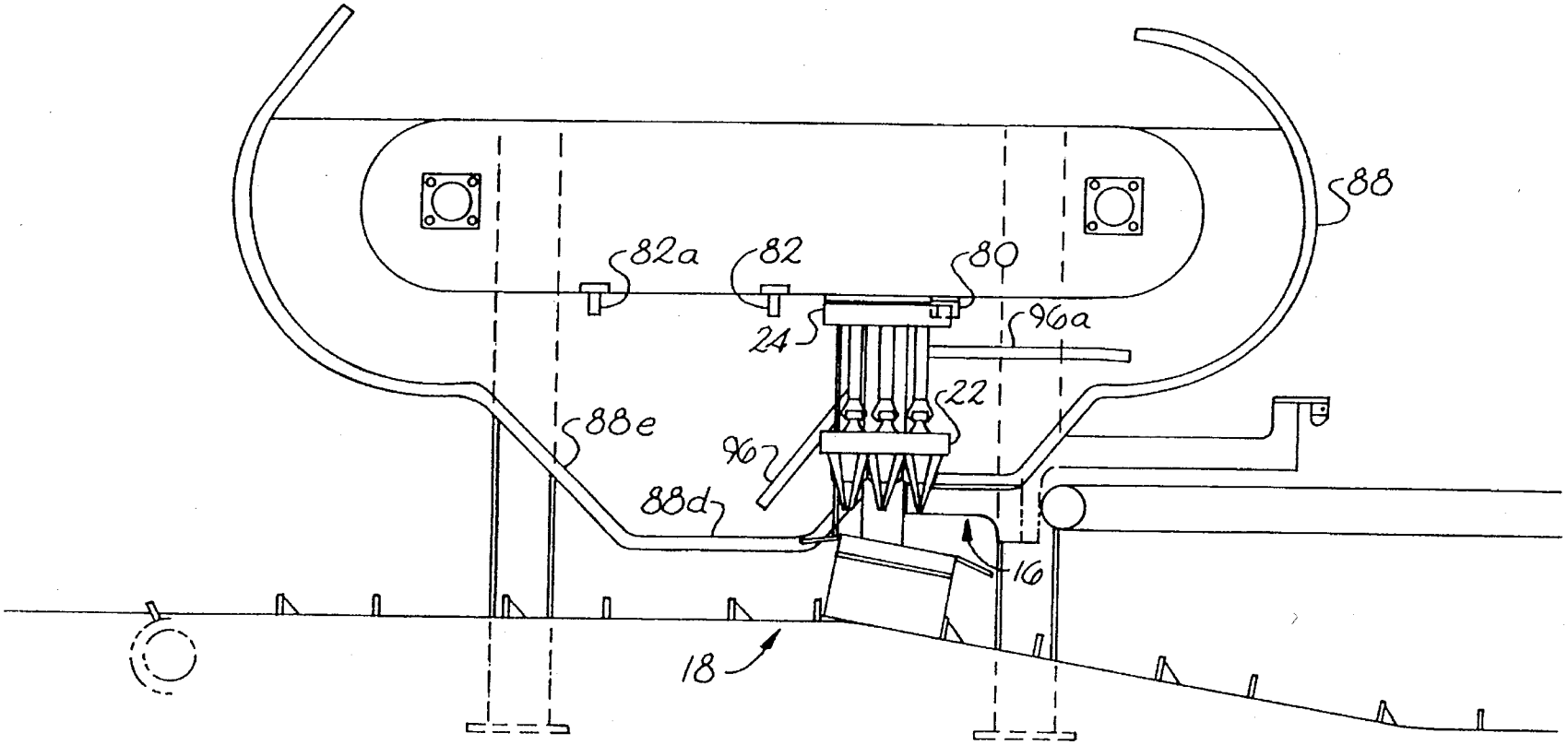
FIG. 2F is a schematic elevation illustrating a continuous motion case packing apparatus and method according to the invention illustrating the relative positions of an article transfer arm having gripper and grid heads, a slug of articles, and indexed case leaving the slug pick-up station.
Figure 2G:
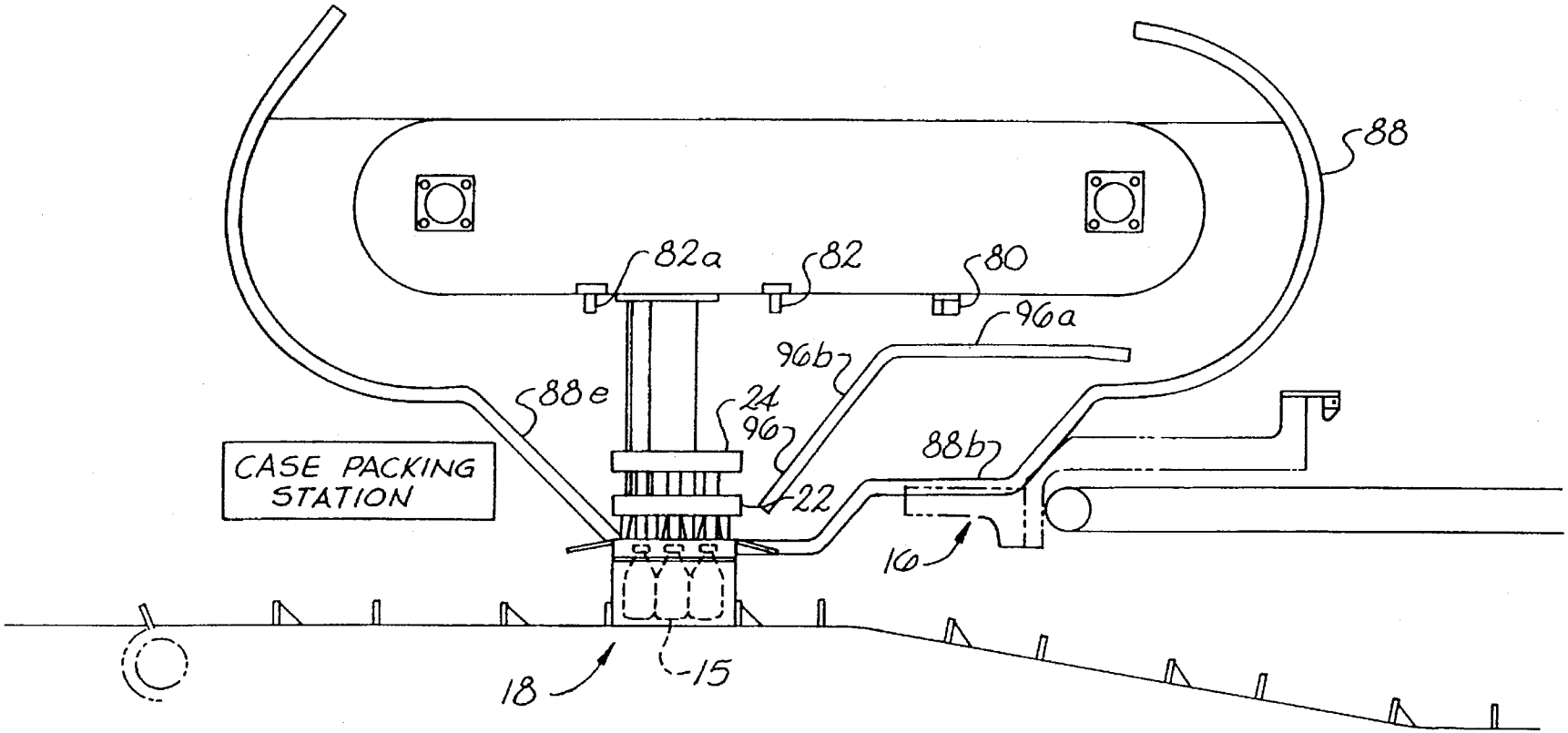
FIG. 2G is a schematic elevation illustrating a continuous motion case packing apparatus and method according to the invention illustrating the relative positions of an article transfer arm having gripper and grid heads, a slug of articles, and indexed case at a case packing station.
Figure 4C:
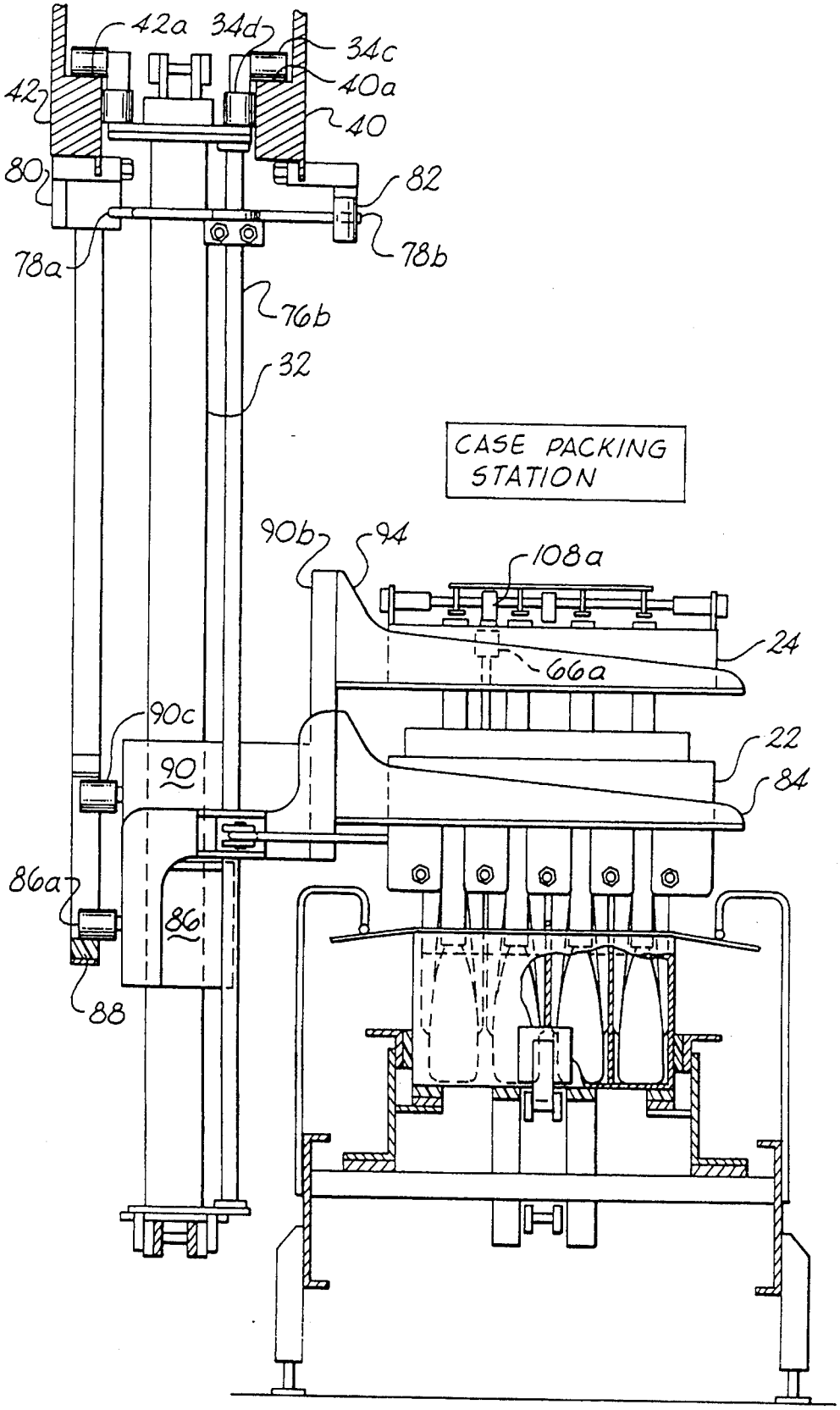
FIG. 4C is a sectional view taken along line 4C—4C of FIG. 3A of a case packing station according to the invention.

The operation of the apparatus for continuously packing articles into cases and method will now be described referring mainly to FIGS. 2C–2I and 4A–4C. First, referring to FIG. 2C, it can be seen that first cam track 88 and bearing block 86; and second cam track 96 and bearing block 90 provide a vertical motion mechanism by which grid head 22 and gripper head 24, respectively, are caused to slide over transfer arms 20 in reciprocating linear movements to be described in reference to FIGS. 2C–2G. These movements will first be described by referring to FIG. 2C, and locations 1 through 9 on the cam tracks and across the linear path of transfer arm 20 as it is carried by carriage C. At location 1, grid head 22 and gripper head 24 are positioned directly above and in alignment with a slug 15, as can best be seen in FIG. 2D. Both the grid chutes and the gripper jaws are open. The gripper jaws are open because gripper actuator arm 108*a* is still engaged by abutment 66*a*, as can best be seen in FIG. 4A. However, as soon as grid head 22 begins its descent over cam track portion 88*a*, abutment 66*a* moves downwardly to release gripper actuator arm 108*a* causing the gripper jaws to close around the necks of articles 13. From locations 2–4, the grid set descends to its lower most position at slug pick-up station 16 (FIG. 2E). At slug pick-up station 16, the gripper jaws grip the articles. The articles 13 have entered the open ends of the grid chutes 54 and the grid fingers defining the chutes have descended a sufficient distance past the bottoms of cantilevered blades 133 to enclose articles 13. Between locations 4 and 5, grid actuator arm 78*a* engages abutment 80 moving all of the grid fingers toward the center of the chutes to close off the chutes and positively retain the articles in the chutes (FIG. 4B). Thus, it can be seen that the articles are picked-up positively at the pick-up station by both the grid head and gripper head. This redundancy provides a highly reliable and fail safe pick-up of the articles which is particularly advantageous for glass containers. At location 5, FIG. 2F, both the grid head and the gripper head begin their descent to case packing station 18 over cam track portions 88*c* and 96*b*, respectively. At location 6, FIG. 2G, grid set 22 and gripper head 24 are at the case packing position. The closed grid fingers of grid head 22 have penetrated into the case at their lowest point (FIG. 4C). In packing partitioned cases, the closed grid fingers easily enter the individual cells of the partitioned case due to their converging configuration. Obviously, the gripper tubes, grid chutes, slugs, and cells defined by the partitions in the cases are arranged in a corresponding matrix. After the grid fingers have reached their lowest point of travel into the case as defined by cam track portion 88*d*, second actuator arm 78*b* strikes second abutment 82 to open the grid chutes. This causes the grid fingers to move away from the center of the chute into the corners of the case cells, or against the chute forming surfaces 70, 73 against which the corner fingers are urged in the chute open position (FIG. 10A) when cases without partitions are being packed. For purposes of clarity, the partitions have been omitted from FIG. 4C. As the gripper head reaches its lowest point of descent somewhere near the end of cam track portion 96*b*, gripper actuator arm 108*a* is again engaged by abutment 66*a* causing the gripper jaws to open. At this point, bearing block 90 which carries gripper head 24 rests on top of bearing block 86 which carries grid head 24. The nested heads are now in a position to be lifted out of the case for their return trip back to slug pick-up station 16. This occurs between locations 8 and 9 over cam track portion 88*e*, FIG. 2H, whereupon grid head 22 travels upwardly to begin its return trip. Referring to FIG. 2I, it can be seen that carriage C moves the transfer arm and pick-up heads in a closed, vertical plane curve 160 which includes a linear path 160, which also includes linear transfer section 126, and a curvilinear return path 162. The curvilinear return path may also be considered as including a portion of path 160 in excess of the linear transfer section.

Figure 19:
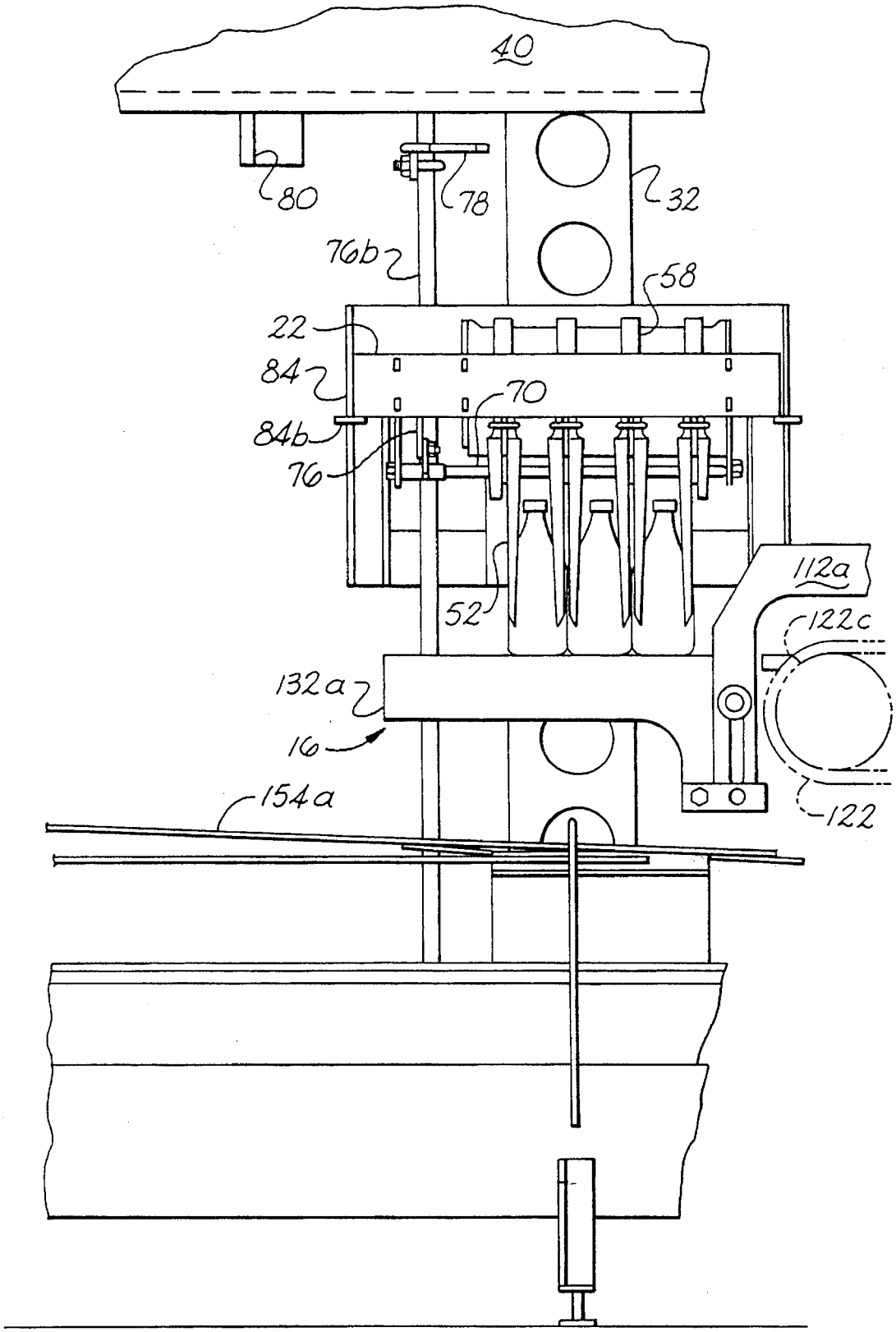
FIG. 19 is a view taken along line 19—19 of FIG. 4A illustrating a continuous motion case packing apparatus and method according to the invention wherein only a reciprocating grid set, shown in a chute open position, is used on an article transfer arm as a drop packer according to the invention.
Figure 20:
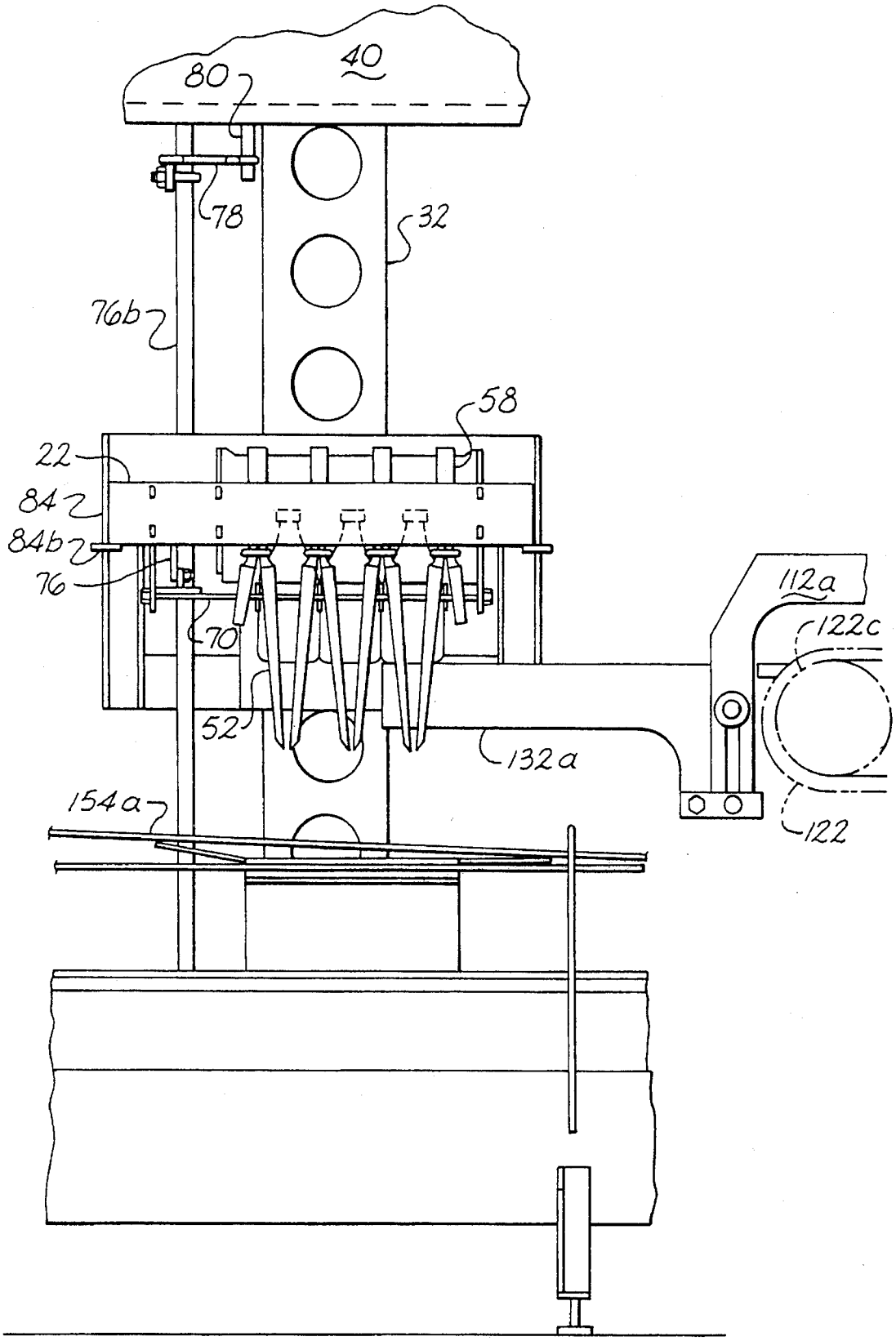
FIG. 20 is a view taken along line 20—20 of FIG. 4B illustrating a continuous motion case packing apparatus and method according to the invention wherein only a reciprocating grid set, shown in a chute closed position for article pick-up, is used on an article transfer arm as a drop packer according to the invention.
Figure 21:
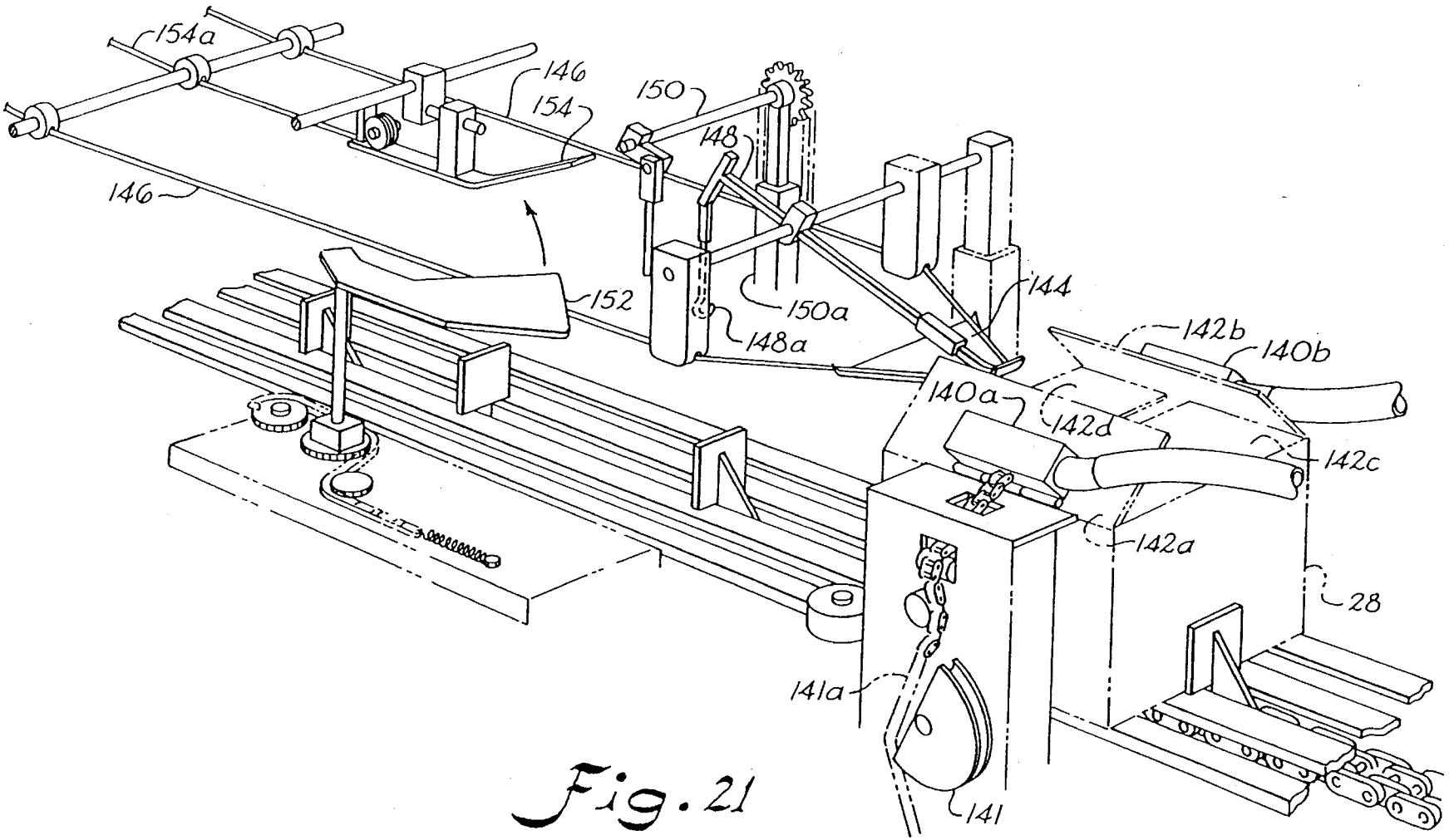

Thus, it can be seen that a advantageous construction can be had for a continuous case packing apparatus can be had according to the invention wherein articles may be positively held by article pick-up heads for reliable transfer from a slug pick-up position over a linear section in which no horizontal acceleration occurs, and a vertical descent for case packing is smooth and gentle. The continuous case packer and method may be used as a drop packer with only grid head 22 employed on transfer arm 20 as shown in FIGS. 19 and 20, or the apparatus may use gripper head 24 and operate more gently as a placement packer, or with both the gripper head and grid head for increase reliability during slug pick up, transfer, and packing. In FIGS. 19 and 20, the case packer operates the same as described previously, except that gripper head 24 has been removed from rack 94. Slug feeder B and adjustable metering mechanism 124, 126, 130 provide a quick and easy changeover to the packaging of different sizes of slugs without the time consuming replacing of parts and down time required by prior packers. The apparatus and method are thus highly versatile, and provide the manufacturer/packer a high degree of flexibility in the articles being packaged on a given run, which has not been provided before by the prior apparatus.

While a preferred embodiment of the invention has been described using specific terms, such description is for illustrative purposes only, and it is to be understood that changes and variations may be made without departing from the spirit or scope of the following claims.

What is claimed is:

1. Apparatus for packing articles conveyed in at least one longitudinal row into cases in a continuous motion comprising:

a slug feeder receiving said row of articles for forming a slug containing a predetermined number of said articles in said row and conveying said articles to a slug pick-up station;

said slug pick-up station supporting said slug of articles in a position to be picked up for transfer to a case packing station;

a vertical revolving carriage which carries a plurality of article transfer arms;

a plurality of article pick-up heads carried by said transfer arms which reciprocate in a linear motion relative to said transfer arms for picking up said slug of articles at said slug pick-up station;

said carriage carrying said transfer arms and pick-up heads in a curved, vertical plane path which includes a linear transfer section between said slug pick-up station and said case packing station in a generally straight line path;

an actuator associated with said pick-up heads having a first position in which a slug of articles is retained by said pick-up head at said slug pick-up station for transfer, and said actuator having a second position in which said slug of articles is released for deposit into said case at said case packing station; and a case indexing conveyor for conveying indexed cases to said case packing station for receiving said released slug in synchronization with said moving carriage and said slug feeder.

2. The apparatus of claim 1 wherein said pick-up heads include grid heads having a plurality of pivoting grid fingers arranged in a grid array corresponding to an array of said articles in said slug, said grid fingers defining grid chutes having upper ends and lower ends, and said grid chutes receive said slug of articles.

3. The apparatus of claim 2 wherein said grid chutes have an open position wherein said lower chute ends are open so that said articles are received into said chutes through said lower ends, and said apparatus includes a vertical motion mechanism for lowering said grid heads relative to said transfer arms over said slug of articles with said grid chutes in said open position.

4. The apparatus of claim 3 wherein said grid fingers have a closed position for retaining articles in said chutes, and said grid actuator acts upon said grid fingers to move said grid fingers to said open and said closed positions.

5. The apparatus of claim 4 wherein said actuator includes a grid actuator mechanism for positively holding said grid fingers in said closed position to positively retain the articles in said grid head.

6. The apparatus of claim 3 including gripper heads carried by said transfer arms together with said grid heads for sliding movement on said transfer arms in linear alignment with said grid heads, said gripper heads having a plurality of article grippers arranged in a matrix corresponding to said grid chutes and slug array, and said grippers constructed and arranged to attach to an upper portion of said articles to lower said slug gently into said case.

7. The apparatus of claim 6 including a gripper actuator for actuating said grippers, and an actuator arm carried on said gripper heads which engages an abutment carried on said grid heads at said case packing station for releasing said slug.

8. The apparatus of claim 6 wherein said grippers include pivoting gripper jaws constructed and arranged to engage said articles to center said articles in the chutes of the grid head.

9. The apparatus of claim 8 wherein said gripper jaws include outwardly tapered wings which engage and center said articles.

10. The apparatus of claim 1 wherein said case indexing conveyor extends in longitudinal alignment with said slug feeder, and indexes said cases at prescribed intervals at which said slugs are fed by said slug feeder and said transfer arms are moved by said carriage.

11. The apparatus of claim 1 including a synchronized drive for said case indexing conveyor, slug feed conveyor, and said carriage for feeding and conveying said slugs and said cases in unison at a constant horizontal speed for packing.

12. The apparatus of claim 1 wherein said pick-up heads include a plurality of reciprocating article gripper heads carried by said transfer arms, and said gripper heads having an array of article grippers arranged in a matrix corresponding to said slug for gripping said articles in said slug.

13. The apparatus of claim 12 wherein said actuator includes a gripper actuator for actuating said grippers to grip said articles.

14. The application of claim 1 wherein said slug feeder includes a slug feed conveyor, a slug metering section, and spaced side rails defining at least one lane for receiving said row of articles which extends through said slug conveyor and slug metering sections.

15. The apparatus of claim 14 wherein said slug metering section includes a revolving flight bar mechanism having a plurality of engaging flight bars which engage a last of said articles in a slug for conveying said slug of articles through said metering section to said slug pick-up station.

16. The apparatus of claim 15 wherein said flight bars extend across said slug metering section and rise above a back article in a row of a first slug and a front article in a row of a second slug to tilt said front article rearward and separate said first and second slugs of articles.

17. The apparatus of claim 16 wherein said slug feed conveyor has a first speed for feeding said articles at a first rate and a second speed for feeding said articles at a second rate which is slower than said first rate; and said slug feed conveyor operating at said second speed at least momentarily as said flight bar engages said back articles facilitating dividing of said articles in said row.

18. The apparatus of claim 15 including a metering block disposed in each lane, and wherein a distance generally defined between said metering block and said flight bar determines the number of articles in a row of said slug of articles.

19. The apparatus of claim 18 wherein said metering block and is carried by an adjustable carrier by which said distance between said metering block and said flight bar may be adjusted so that said number of articles in said row may be adjusted.

20. The apparatus of claim 19 including a drive mechanism for moving said metering block in cyclic motions in and out of a conveyance path of said articles in said slug metering section in synchronization with said revolving flight bar.

21. The apparatus of claim 20 wherein said drive mechanism includes a cam plate carried on said carrier for guiding said metering block is said cyclic motions which include reciprocating horizontal and vertical motions, and a timing cam connected to said cam plate for timing and driving of said metering block in said cyclic motions.

22. The apparatus of claim 21 wherein said timing cam is driven by a drive shaft and said apparatus includes an adjustable coupling securing said timing cam to said drive shaft by which the relative rotational position between said timing cam and drive shaft may be varied corresponding to said distance between said metering block and said flight bar.

23. The apparatus of claim 22 wherein said slug metering section includes bottom skids carried centrally in the bottom of each lane between adjacent side rails for supporting the bottom of said articles in the lane, and a metering block is associated with each skid and slides relative thereto.

24. The apparatus of claim 23 including an adjustable skid mechanism which carries said skids for lateral adjustment in slug metering section, and said adjustable skid mechanism includes transverse rods slidably carrying said skids, and removable spacer blocks carried by said rods to vary the center spacing of said skids between side rails.

25. The apparatus of claim 14 including a plurality of spaced cantilevered pick-up blades arranged in parallel alignment near an end of said metering section which constitute said slug pick-up station.

26. The apparatus of claim 6 wherein said indexed cases consist of partitioned cases having cells defined by partitions within said case, and said cells are arranged in a matrix corresponding to said array of grid chutes and grippers.

27. Apparatus for continuously packing articles into cases which includes a slug feeder for receiving articles conveyed in at least one row for forming a slug of said articles containing a predetermined number of said articles in said row; and a slug pick-up station for supporting said slug of articles in a position to be picked up and transferred to a case packing station for being deposited in a partitioned case; said apparatus comprising:

a plurality of transfer arms;

a plurality of grid heads slidably carried by said transfer arms which reciprocate in a linear motion relative to said transfer arms for picking up said slug of articles at said slug pick-up station and for transferring said slug of articles to said case packing station;

an array of pivotal grid fingers depending downwardly from said grid heads to define a matrix of grid chutes corresponding to a matrix of said articles in said slug which have an open and a closed position;

a plurality of reciprocating article gripper heads carried by said transfer arms in alignment with said grid heads, said gripper heads having an array of article grippers arranged in a matrix corresponding to said slug for holding said articles in said slug in a positive manner within said grid beads;

a vertical motion mechanism for lowering said grid heads and gripper heads over said slug of articles at said slug pick-up station with said chute ends extending below a bottom level of said slug of articles when said chutes are in said open position, and for lowering said grid head into said partitioned case for releasing said articles therethrough when said chutes are in said closed position;

a carriage carried by a frame for moving said transfer arms between said slug pick-up station and said case packing station;

an actuator having a first position in which said grid fingers are moved toward a center of said grid chutes for closure beneath said articles while said grid head is moved from said slug pick-up station to said case pick-up station; and said actuator having a second position in which said grid fingers are moved away from said center of said grid chutes to open said grid chutes so that said retained articles pass through said grid chutes and are deposited in said case at said case packing station.

28. The apparatus of claim 27 wherein said grid head includes a locking element associated with said grid fingers for positively maintaining said grid fingers in a chute open position wherein said fingers are vertically positioned near corners of said chutes.

29. The apparatus of claim 28 including:

a plurality of spacer bars spaced cross said grid head;

said grid fingers being pivotally carried by said spacer bars in a manner that said grid fingers pivot relative to spacer bars at a pivot intermediate an upper body portion of said fingers and a lower main body portion of said fingers; and a locking grid disposed above said upper portions of said fingers which carry said locking elements so that said locking elements engage said upper finger portions and maintain said fingers locked in said open chute position.

30. The apparatus of claim 29 wherein said locking grid comprises:

a frame;

a plurality of support bars extending across said frame upon which said locking elements are carried; and said locking elements having an apex portion which engages terminal ends of said upper finger portions of said grid fingers for urging said fingers into said chute open position.

31. The apparatus of claim 26 wherein said grid actuator comprises an actuator linkage assembly for moving said fingers toward said center of said grid chutes; and an actuator arm connected to said actuator linkage assembly.

32. The apparatus of claim 31 including a first abutment carried near said transfer arms in said linear transfer section; and said actuator arm is constructed and arranged for engaging said first abutment to move said grid fingers and close said chutes after said grid fingers are received over said slug of articles at said pickup station.

33. The apparatus of claim 32 wherein said actuator arm includes a fork having first and second arms; and said first arm is engaged by said first abutment to close said grid chutes, and said second arm is engaged by a second abutment disposed along said linear transfer section to allow said fingers to move and open said grid chutes after said grid fingers have penetrated a desired distance into said case at said case packing station.

34. The apparatus of claim 26 wherein said vertical motion mechanism includes guide bearings slidably carried by said transfer arms, a cam track carried by said frame, a cam roller carried by said guide bearings which follows said cam track, and said grid heads being carried by said guide bearings for following said cam track.

35. The apparatus of claim 30 including at least one biasing member urging said locking grid towards said grid head for urging said apex portion of said locking elements into contact with said upper portions of said fingers.

36. Apparatus for continuously packing articles into cases which includes a slug feeder receiving articles in at least one row for forming successive slugs of articles containing a predetermined number of said articles in said row and continuously feeding said slugs to a slug pick-up station where said slugs are picked up and transferred to a case packing station, said apparatus comprising:

a plurality of article transfer arms;

a plurality of reciprocating article pick-up heads carried by said transfer arms which slide in a linear motion relative to said transfer arms for picking up said slug of articles at said slug pick-up station and for releasing said slug of articles for deposit into said case at said case packing station;

a vertical revolving carriage continuously moving said transfer arms in a curved, vertical plane path to continuously move said pick-up heads and articles from said slug pick-up station to said case packing station generally in a straight line path; and an actuator having a first position for actuating said pick-up head at said pick-up station so that said articles are retained by said pick-up head for transfer, and said actuator having a second position for releasing said pick-up head at said case packing station so that said slug of articles is deposited into said case.

37. The apparatus of claim 36 wherein said article pick-up head includes:

a grid head having an array of grid chutes arranged in a matrix corresponding to an array of said articles in said slug;

said grid chutes having an open position in which said articles may be received within said chutes, and said chutes having a closed position in which said articles are retained within said chutes for transfer to said case packing stations;

a vertical motion mechanism for lowering said grid head over said slug of articles at said slug pick-up station with said chutes in said open position; and a grid actuator having first position in which said grid chutes are closed at said pick-up station so that said articles are retained within said grid chutes for transfer, and said actuator having a second position in which said grid chutes are open at said case packing station for releasing said slug of articles into said case.

38. The apparatus of claim 37 including a plurality of reciprocating article gripper heads carried by said transfer arms in alignment with said grid heads, said gripper heads having an array of article grippers arranged in a matrix corresponding to said slug for positively holding said slug of articles in conjunction with said grid heads, and a gripper actuator for actuating said grippers to grip said articles, and an abutment carried by said gripper head for actuating said gripper actuation when said gripper head and grid head are in proximity to each other.

39. The apparatus of claim 37 wherein said grid head includes a locking element associated with said grid fingers for positively maintaining said grid fingers in a chute open position wherein said fingers are positioned near corners of said chutes.

40. The apparatus of claim 36 wherein said article pick-up heads include a plurality of reciprocating article gripper heads carried by said transfer arms, and said gripper heads have an array of article grippers arranged in a matrix corresponding to said slug for positively holding said slug of articles.

41. The apparatus of claim 36 wherein said carriage moves said transfer arms in a closed cyclic path which includes a linear transfer section at least between said pick-up station and said case packing station, and a curvilinear return path from said case packing station to said pick-up station.

42. The apparatus of claim 41 wherein said carriage moves said transfer arms and pick-up heads at a generally constant horizontal speed across said linear transfer section to transfer said slug of articles from said slug pick-up station to said case packing station generally without horizontal acceleration of said articles.

43. The apparatus of claim 42 including a case indexing conveyor disposed below said slug feeder for conveying indexed cases at the same interval at which said slugs are fed by said slug feeder, and including a synchronized drive system for driving said case indexing conveyor, said slug feeder, and said carriage for feeding and conveying said slugs and cases in unison at said constant horizontal speed for case packing.

44. Apparatus for continuously packing articles into cases which includes an infeed conveyor for feeding articles in at least one longitudinal row; said apparatus comprising:

a slug feeder for receiving said row of articles and forming successive slugs of said articles containing a predetermined number of said articles;

said slug feeder continuously feeding said slugs of articles along a slug feed axis to a slug pick-up station where said slug of articles are continuously picked up for transfer to a case packing station;

a plurality of article transfer arms;

a plurality of reciprocating article pick-up heads carried by said transfer arms which slide in a linear motion relative to said transfer arms for picking up said slug of articles at said slug pick-up station;

a revolving carriage moving said transfer arms and said pick-up heads along a pick-up head transfer axis and having a linear transfer path over which said slugs of articles are continuously transferred from said slug pick-up station to said case packing station;

a case indexing conveyor for delivering indexed cases to said case packing station along a case conveyor axis; and said slug feeder axis, said pick-up head transfer axis, and said indexing case conveyor axis lying generally in a common vertical plane.

45. The apparatus of claim 44 including a synchronized drive for said case indexing conveyor, slug feed conveyor, and said carriage for feeding and conveying said slugs and said cases in unison at a constant horizontal speed for packing.

46. Apparatus for continuously packing articles into cases which includes a slug feeder for receiving said articles in at least one row and forming a slug of said articles containing a predetermined number of said articles; and a slug pick-up station for supporting said slug of articles in a position to be picked up for transfer to a case packing station where said slug of articles is deposited into a case; said apparatus comprising:

a plurality of article transfer arms;

a plurality of reciprocating article pick-up heads carried by said transfer arms for picking up said slug of articles at said slug pick-up station;

a carriage moving said transfer arms in a closed cyclic path which includes a linear transfer section at least from said pick-up station to said case packing station along which said slug of articles are moved generally along a straight line path, and a curvilinear return path from said case packing station to said pick-up station;

said carriage moving said transfer arms and pick-up heads at a generally constant horizontal speed along said linear transfer section to transfer said slug of articles from said slug pick-up station to said case packing station generally without horizontal acceleration of said articles; and a vertical motion mechanism connected to said pick-up heads for guiding said pick-up heads in a vertical motion so that said pick-up heads are lowered to said case packing station while said carriage moves said pick-up heads at said constant horizontal speed.

47. The apparatus of claim 46 wherein said article pick-up heads include:

a plurality of grid heads slidably carried by said transfer arms which reciprocate in a linear motion relative to said transfer arms for picking up said slug of articles at said slug pick-up station and for transferring said slug of articles to said case packing station; and an array of pivotal grid fingers depending downwardly from said grid head to define a matrix of grid chutes corresponding to a matrix of said articles in said slug, and said slug of articles being received in said grid chutes during pick-up and transfer of said articles.

48. The apparatus of claim 47 including:

a plurality of gripper heads having an array of article grippers arranged in a matrix corresponding to a matrix of said articles in said slug for gripping an upper portion of said articles; and said gripper heads being carried by said transfer arms for collinear reciprocation with said grid heads.

49. The apparatus of claim 47 including reciprocating guides carried by said transfer arms which slide in linear motion relative to said transfer arms, and said article pick-up heads being carried by said reciprocating guides for reciprocating linearly relative to said transfer arms.

50. The apparatus of claim 47 wherein said article pick-up heads include a plurality of gripper heads having an array of article grippers arranged in a matrix corresponding to a matrix of said articles in said slug for attaching to an upper portion of said articles.

51. The apparatus of claim 47 including an actuator having a first position for actuating said pick-up head at said pick-up station to retain said articles for transfer, and said actuator having a second position for actuating said pick-up head to release said slug of articles at said case packing station and deposit said articles into said case.

52. A grid head for use with apparatus for continuously packing articles into cases which includes a slug feeder for receiving said articles in at least one row and forming successive slugs of articles containing a predetermined number of said articles; a slug pick-up station for continuously receiving said slugs of articles for pick-up and transfer to a case packing station; a revolving carriage which carries a plurality of transfer arms between said slug pick-up station and said case packing station; a plurality of reciprocating grid heads carried by said transfer arms for picking up said slugs of articles at said slug pick-up station and transferring said slugs to said case packing station; said grid head comprising:

an array of pivotal grid fingers depending downwardly from said grid head to define a matrix of grid chutes corresponding to a matrix of said articles in said slug;

said grid chutes having lower chute ends through which said slug of articles enter and exit said grid chutes, and said grid chutes having an open position in which said grid chutes are lowered over said articles in said slug at said slug pick-up station;

said grid chutes having a closed position in which said articles are retained within said chutes above said lower chute ends for transfer to said case packing station;

a grid actuator having a first position in which said grid fingers move toward a center of said chutes for closing said grid chutes at said pick-up station so that said articles are retained within said grid chutes for transfer; and said grid actuator having a second position in which said grid fingers move away from said center of said chute for opening said grid chutes at said case packing station to release said slug of articles for deposit into said case.

53. The apparatus of claim 52 wherein said grid head includes a locking element associated with said grid fingers for positively maintaining said grid fingers in a chute open position.

54. The apparatus of claim 53 including:

a plurality of spacer bars spaced cross said grid head;

said grid fingers being carried by said spacer bars in a manner that said grid fingers pivot relative to spacer bars at a pivot intermediate an upper finger portion of said fingers and a main body portion of said fingers; and a locking grid disposed above said upper portions of said fingers which carry said locking elements so that said locking elements engage said upper finger portions and maintain said fingers locked in said open chute position.

55. The apparatus of claim 54 wherein said locking grid comprises:

a frame;

a plurality of support bars extending across said frame upon which said locking elements are carried; and said locking elements having an apex portion which engages terminal ends of said upper finger portions of said grid fingers for urging said fingers into said open position.

56. The apparatus of claim 55 including at least one biasing member urging said locking grid towards said grid head for urging said apex portion of said locking elements into contact with said terminal ends of said fingers.

57. For use with apparatus which continuously packs articles into cases which includes a lane for feeding articles in at least one longitudinal row defined by a lane, a lane infeed conveyor for conveying said row of articles; a carriage which carries a plurality of transfer arms; a plurality of article pick-up heads carried by said transfer arms for picking up a slug of articles at a slug pick-up station and for transferring said slug of articles to a case packing station; a slug feeder comprising:

a slug feeder for receiving said row of articles from said laner;

a slug feed conveyor included in said slug feeder for receiving articles from said lane infeed conveyor in a continuous manner;

a slug metering section included in said slug feeder continuously receiving articles from said slug feed conveyor for creating a slug of said articles containing a predetermined number of said articles;

a revolving abutment mechanism carried in said slug metering section having a revolving abutment for engaging a last of said articles in each row of said slug;

a slug metering block movably carried in said slug metering section which moves in and out of a path of conveyance of said articles in a cyclic manner independent of said revolving abutment;

a metering distance defined between said metering block and said revolving abutment which determines the number of said articles in said row and the size of said slug;

a drive mechanism for driving said slug metering block in said cyclic movements in and out of said article conveyance path; and a slug pick-up station continuously receiving said slugs of articles from said slug metering section for supporting said slug of articles for being picked up for transfer to said case packing station for being deposited in a case.

58. The apparatus of claim 57 wherein said slug feed conveyor includes a two-speed conveyor having a first speed for feeding said articles against said metering block, and said conveyor having a second speed for feeding said articles after said metering block has moved out of said article conveyance path, and said second speed momentarily feeds said articles at a slower rate than said first speed whereby said articles in said infeed are maintained in a contacting relation with each other and metering block during said first speed.

59. The apparatus of claim 58 wherein said metering block is carried by an adjustable carrier by which said metering distance between said metering block relative to said revolving abutment may be adjusted to determine the number of articles in said row and said slug size.

60. The apparatus of claim 57 wherein said metering block is carried by an adjustable carrier by which said metering distance between said metering block and said revolving abutment may be adjusted to determine the number of articles in said row and said slug size.

61. The apparatus of claim 60 wherein said revolving abutment mechanism includes a plurality of flight bars which engage said last articles in said slugs for conveying said slugs through said metering section.

62. The apparatus of claim 61 wherein said flight bars extend across said slug metering section and rise to engage a back article in a row of a first slug and a front article in a row of a second slug to tilt said front article rearward and separate said first and second slugs of articles.

63. The apparatus of claim 60 wherein said drive mechanism includes a cam plate carried on said carrier for guiding said metering block is said cyclic motions which include reciprocating horizontal and vertical motions, and a timing cam connected to said cam plate for timing and driving of said metering block in said cyclic motions.

64. The apparatus of claim 63 wherein said timing cam is driven by a drive shaft and said apparatus includes an adjustable coupling securing said timing cam to said drive shaft by which the relative rotational position between said timing cam and drive shaft by be varied corresponding to said distance between said metering block and said abutment.

65. The apparatus of claim 57 wherein said slug pick-up station includes a plurality of spaced cantilevered pick-up blades arranged in longitudinal alignment with the skids which constitute said slug pick-up station.

66. The apparatus of claim 57 wherein said slug feeder includes spaced side rails defining at least one lane for receiving said row of articles which extends through said slug conveyor and slug metering sections, and an adjustable side rail assembly for adjusting the lateral spacing between said side rails so that the number and width of said lanes may be adjusted.

67. The apparatus of claim 57 wherein said slug metering section includes bottom skids carried in the bottom of each lane between adjacent side rails for supporting the bottom of said articles in the lane.

68. The apparatus of claim 67 including an adjustable skid mechanism which carries said skids for lateral adjustment in slug metering section, and said adjustable skid mechanism includes transverse rods slidably carrying said skids, and a removable spacer block carried by said rods to vary the center spacing of said skids between side rails.

69. The apparatus of claim 67 wherein said metering block is slidably carried relative to said skid in said lane, and including a drive mechanism for moving said metering block in horizontal and vertical motions independent of said abutment.

70. A method of continuously packaging articles into a case comprising:

continuously conveying said articles in at least one longitudinal row;

continuously dividing said articles into separate, successive slugs of articles wherein said slugs contain a prescribed number of articles;

conveying said slugs of articles to a slug pick-up station;

picking up said slug of articles at said pick-up station using a linearly reciprocating pick-up head carried on a transfer arm;

rotating said transfer arm in a vertical plane curved path which includes a linear transfer section between said pick-up station and a case packing station to continuously transfer said slugs in a generally straight line path between said stations; and moving said pick-up head vertically in a linear motion to lower said slug of articles for deposit into said case at said case packing station.

71. A method of continuously packing articles into a case at a case packing station comprising:

continuously conveying said articles in at least one longitudinal row;

continuously dividing said articles into slugs of articles wherein said slugs contain a prescribed number of said articles;

continuously conveying said slugs of articles to a slug pick-up station;

moving a grid head having a plurality of grid chutes arranged in a matrix corresponding to an array of said articles in said slugs into a slug pick-up position directly above said slugs at said slug pick-up station;

moving said grid head downwardly over said slug of articles with a lower end of said chutes being open for receiving said articles with said chutes;

closing said chutes to retain said articles in said chutes of said grid head while moving said grid head from said slug pick-up station to a case pick-up station; and releasing said slug of articles from said grid chutes into said cases at said case packing station.

72. The method of claim 71 including providing a gripper head having a plurality of grippers for gripping said articles and reciprocating said gripper head in linear movements in alignment with said grid heads; and gripping said articles with said gripper head as said grid head moves downwardly over said slug for retaining said articles together with said grid head for transferring to said case packing station.

73. The method of claim 71 including packing said slugs into partitioned cases having cells defined by partitions within said cases, and providing said array of grid chutes in a matrix corresponding to said cells.

74. A method for continuously packing articles into a case including arranging said articles in at least one longitudinal row; dividing said articles into slugs of articles which contain a predetermined number of said articles; picking said slug of articles up at an article pick-up station and transferring said slug of articles to a case packing station where said slug of articles is deposited into said case; said method comprising:

conveying said articles on a slug feed conveyor to a slug metering section;

feeding a first article in said row against a metering device while engaging a last article in said row with a revolving abutment whereby said slug of articles is defined by a metering distance between said metering device and said abutment to fix the number of articles between said metering device and said abutment;

moving said metering device out of contact with said first article on engagement as said abutment conveys said slug away from said metering section to said slug pick-up station; and mounting one of said metering device or revolving abutment on an adjustable carrier so that said metering distance may be adjusted to vary the slug size.

75. The method of claim 74 including mounting said metering device on a drive mechanism which moves said metering device in translational and reciprocating motions.

76. The method of claim 75 including mounting said drive mechanism for said metering device on a moveable carrier so that said metering distance between said metering device and said bar may be adjusted to vary the number of articles in said slug.

* * * * *